US010119234B1

(12) United States Patent
Yeany

(10) Patent No.: US 10,119,234 B1
(45) Date of Patent: Nov. 6, 2018

(54) PROCESS FOR INSTALLING A MODULAR RETAINING WALL

(71) Applicant: Truline, LLC, Naples, FL (US)

(72) Inventor: Scott A. Yeany, Bogart, GA (US)

(73) Assignee: Truline, LLC, Naples, FL (US)

( * ) Notice: Subject to any disclaimer, the term of this patent is extended or adjusted under 35 U.S.C. 154(b) by 0 days.

(21) Appl. No.: 15/651,007

(22) Filed: Jul. 17, 2017

(51) Int. Cl.

| | |
|---|---|
| ***E02B 3/14*** | (2006.01) |
| ***E02B 3/06*** | (2006.01) |
| ***E02D 5/03*** | (2006.01) |
| ***E02D 29/02*** | (2006.01) |
| *E02D 5/00* | (2006.01) |
| *E04B 2/00* | (2006.01) |
| *E02B 3/00* | (2006.01) |

(52) U.S. Cl.
CPC ..... *E02B 3/14* (2013.01); *E02B 3/06* (2013.01); *E02D 5/03* (2013.01); *E02D 29/02* (2013.01); *E02B 3/00* (2013.01); *E02D 5/00* (2013.01); *E04B 2/00* (2013.01)

(58) Field of Classification Search
CPC combination set(s) only.
See application file for complete search history.

(56) References Cited

U.S. PATENT DOCUMENTS

| | | | | |
|---|---|---|---|---|
| 5,503,503 | A | 4/1996 | Glass et al. | |
| 5,803,672 | A | 9/1998 | Glass et al. | |
| 6,231,271 | B1 | 5/2001 | Glass et al. | |
| 7,056,066 | B2 | 6/2006 | Irvine | |
| 7,628,570 | B2 | 12/2009 | Davidsaver et al. | |
| 7,914,237 | B2 | 3/2011 | Glass et al. | |
| 8,033,759 | B2 | 10/2011 | Davidsaver et al. | |
| 9,593,456 | B2 | 3/2017 | Irvine et al. | |
| 2005/0053429 | A1* | 3/2005 | Davidsaver | E02B 3/06 405/284 |
| 2007/0065235 | A1* | 3/2007 | Glass | E02D 7/20 405/276 |
| 2011/0064526 | A1* | 3/2011 | White | E02D 3/08 405/245 |
| 2011/0280670 | A1 | 11/2011 | Irvine et al. | |
| 2016/0290843 | A1 | 10/2016 | Heide et al. | |
| 2017/0145649 | A1 | 5/2017 | Irvine et al. | |

OTHER PUBLICATIONS

Lee Composites Inc. website page http://www.leecomposites.com/Environ.html Seawall Bulkhead Construction copyright 2010—printed on Jul. 16, 2015.
ESP Everlast ESP 2.1 Seawall Specification—Rev. Jul. 14, 2009.
(Continued)

*Primary Examiner* — Kyle Armstrong
(74) *Attorney, Agent, or Firm* — Fisherbroyles LLP; Louis Wagner

(57) ABSTRACT

A process for installing a modular retaining wall is illustrated and described having open or closed polygonal modules with channels disposed therein. The wall is set at least partially below a surface, the surface either being land-based or aqueous-based, and interfaces therebetween, e.g., shoreline. The modules of the wall are fastened to each other by respective fastening mating fasteners. The retaining wall is installed by a process employing a fluid-assisted internal mandrel.

10 Claims, 28 Drawing Sheets

(56) References Cited

OTHER PUBLICATIONS

Development, Desig, and Applications of Synthetic Sheet Pile by Everlast Synthetic Products, Technical Support and Sales, David Westland, P.E., published Sep. 16, 2011.
ThyssenKrupp Steelcom brochure dated Aug. 2014.
Ecolock Vinyl Sheet Piling webpages from http://www.vinylpiling.eu/vinyl-sheet-piling (undated) printed on Jul. 6, 2015.
Everlast Engineering Solutions brochure (undated).
Everlast ESP Development, Design, and Application of Synthetic Sheet Pile by David Wentland, P.E. (undated).
The Hammermans' Weblog at https://miniape.wordpress.com posted on Aug. 14, 2014 printed on Jul. 6, 2015.
Webpage from http://plasticpiling.co.uk/HammermanEquipment/Pilingmandrels/tablid/186/Default.aspx printed on Jul. 6, 2015.
YouTube videolink uploaded on Sep. 9, 2009 regarding "The internal mandrel used to drive MultiLock with the Environmental agency", T.H.E Plastic Piling Company Limited.
YouTube videolink uploaded on Jan. 9, 2012 regarding PileClaw Installation—ShoreGuard Vinuyl Sheet Piling.

* cited by examiner

PROCESS FOR INSTALLING A MODULAR RETAINING WALL

TECHNICAL FIELD

The invention described herein pertains generally to retaining walls, and more specifically to retaining walls for use in controlling land erosion in contact with water.

BACKGROUND OF THE INVENTION

Over the many years, there has long existed the problem of land erosion adjacent waterways, rivers, lakes and oceans wherein seawalls of various types have heretofore been constructed of wood, steel or cement. Heretofore, efforts have been made to provide a series of seawall elements which are laterally aligned and in some manner interconnected and pounded down into the ground and anchored. Illustrative of earlier prior art efforts to provide a seawall, constructed of reinforced concrete, is U.S. Pat. No. 1,332,655 issued to R. B. Willard in 1920. The problem then as recognized by the inventor and thereafter, has been the enormous pressures and loads applied to the seawall which have ultimately destroyed the connection between adjacent seawall elements to render the seawall less than effective and ultimately requiring replacement and repairs.

It is known to form seawalls of a plurality of panels formed of extruded PVC material and interconnected edge to edge, as shown in Berger, U.S. Pat. No. 4,674,921 issued Jun. 23, 1987 and U.S. Pat. No. 4,690,588 issued Sep. 1, 1987. In Berger, panel strips of corrugated or sinusoidal shape are formed with alternating groove edges and tongue edges, permitting the panels to be interlocked along their vertical marginal edges. Wale elements are mounted along outer surfaces of the panel strips and accept tie bolts or tie rods extending to ground anchors on the opposite side of the seawall. Berger also discloses angled strips for making corners, and connectors for joining adjacent strips in edge-to-edge relation.

Sinusoidal or corrugated sheets have been mounted in facing relation and connected or joined by tie rods, and the spaces therebetween have been filled with concrete or mortar to provide a water-tight joint, to form a revetment, as shown in Schneller, U.S. Pat. No. 3,247,673 of Apr. 26, 1966.

Sinusoidal or corrugated panel sections have been used to make up retaining walls or seawalls, with wale elements on a front surface tied back to anchors, as shown in several prior patents. Caples, U.S. Pat. No. 1,947,151 of Feb. 13, 1934 shows panel sections formed with interconnecting locking vertical edges in alternating inwardly and outwardly directed portions to form a sinusoidal wall. In Caples, the interlocking ends are identical. In Frederick, U.S. Pat. No. 3,822,557 of Jul. 9, 1974, one panel vertical edge is formed with a tongue and the opposite panel vertical edge is formed with a groove proportioned to receive the tongue of an adjacent panel.

Another example of a retaining wall made of interlocking sections of sheet material is McGrath, U.S. Pat. No. 2,968,931 of Jan. 24, 1961. In McGrath each panel section is bent into three angular portions, and each panel section is reversed when connected, edge to edge to form a sinusoidal-like pattern.

Earlier examples of wall systems having interlocking panel sections which are assembled in longitudinal alignment, with interlocking vertical edges, include Clarke, U.S. Pat. No. 972,059 of Oct. 4, 1910; Boardman et al, U.S. Pat. No. 1,422,821 of Jul. 18, 1922; and Stockfleth, U.S. Pat. No. 1,371,709 of Mar. 15, 1921.

It is also known to use a series of individual arcuate sections which are then joined or interconnected to form a retainer wall, as shown in Van Weele, U.S. Pat. No. 4,407,612 of Oct. 4, 1983.

While walls formed by corrugated panel sections are extensively shown in the prior art in which the corrugations or the axes of the corrugations run vertically, is also known to form panel sections in which the axes of the corrugations run horizontally, as shown in Sivachenko U.S. Pat. No. 4,099,359 of Jul. 11, 1978. FIGS. 7 and 8 also show opposed facing pairs of corrugated sections in which the spaces therebetween may be filled with concrete to form a revetment.

It is common to use wale brackets or wale elements in combination with panel-type seawalls or retainer walls. Berger, Schnabel, Jr. and Caples show wale elements in longitudinal alignment. Schnabel, Jr., U.S. Pat. No. 3,541,798 of Nov. 24, 1970 shows individual longitudinally spaced wale elements along the wall front face. The wale elements receive tie-back rods, which rods extend through or between the panels to suitable anchors.

Essentially two-dimensional polymeric retaining wall members with interlocking members along the edges that are universally mateable to like members are illustrated in U.S. Pat. No. 4,863,315, issued Sep. 5, 1989 to Wickberg while a wall system which employs a plurality of individual panels formed of extruded polymer joined in edge-to-edge relation including wale members which are vertically offset and interlocked at end portions thereof with adjacent wale members is shown in U.S. Pat. No. 4,917,543, issued Apr. 17, 1990 to Cole et al.

A shoreline erosion prevention bulkhead system which employs a series of interlocking fiberglass panels is shown in U.S. Pat. No. 5,066,353 issued Nov. 19, 1991, to Bourdo while a plastic structural panel and ground erosion barrier is illustrated which in general is a stretched Z-shaped cross-sectional design with opposed male and female interlock edges for mating association with adjacent panel strips in U.S. Pat. No. 5,145,287 issued Sep. 8, 1992 to Hooper et al.

Corner adapters for use with corrugated barrier sections are disclosed in U.S. Pat. No. 5,292,208 issued Mar. 8, 1994 to Berger and a sheet piling extrusion with locking members is illustrated in U.S. Pat. No. 6,000,883 to Irving et al. A reinforced Z-shaped configuration of the same with strengthening ribs is illustrated in U.S. Pat. No. 6,033,155 issued Mar. 7, 200 to Irvine et al. A generally U-shaped seawall panel is disclosed in U.S. Pat. No. 6,575,667 issued Jun. 10, 2003 to Burt et al.

This invention was developed to continue to advance the state-of-the-art for installing retaining walls, particularly extruded polyvinyl chloride (PVC) retaining walls which offer easier installation and greater structural integrity than those found in the Prior Art.

SUMMARY OF THE INVENTION

It is an aspect of the present invention to provide a modular barrier or retaining wall, particularly for use in tidal environments where land erosion is a problem.

It is another aspect of the invention to provide a modular barrier wall which utilizes linear U-shaped (optionally polygon-shaped—whether open or closed polygon) channel modules and angled (optionally polygon-shaped—whether open or closed polygon) channel modules which through mating engagement of male projections and female receptacles, effect wall construction which is self-aligning.

It is still yet another aspect of the invention to provide a modular retaining wall which permits wall construction to angle either outward or inward by inserting the appropriate end of an angled module, the angled module being essentially a mirror-image of each other as viewed through a bisecting horizontal line through the angled module.

It is a further aspect of the invention to improve on existing seawall "sheet pilings" of plastic material by exposing a smooth face toward both the sea and the land using a substantially rigid three-dimensional structure which employs a double connection system which is locked into a fixed location. A connection hook is employed which allows for clearing of external material during installation. The final structure is hollow and can be filled with gravel, concrete, etc., to achieve a higher strength. The smooth surfaces are not only more visually appealing, but also make installation easier due to the ease of concrete form construction. Additionally, angled modules are provided which allow for a radiused appearance.

It is still a further object of this invention to employ a two-point connection that makes for faster installation because the three-dimensional profile cannot twist or bow to the degree of existing two-dimensional products. This means less driving energy will be absorbed by the pile making it faster to drive. It also reduces rework required to correct misplaced piles in that they will not have to be withdrawn and replaced.

A process is described to install retaining wall modules, at least one module having a longitudinally open U-shaped channel disposed therein including the steps of: inserting a mandrel into the at least one module having the longitudinally open U-shaped channel, the mandrel having a mandrel length along its longitudinal axis greater than the module length along its longitudinal axis, the mandrel comprising: two opposed pairs of connected sides forming an enclosed longitudinal mandrel channel, the channel having a top portion and a bottom portion; a fluid conduit disposed within the mandrel channel, the fluid conduit having an inlet and an outlet; the top portion of the mandrel securely positioned on a top of at least one of the opposed pair of connected sides of the mandrel, the top portion having an upwardly-extending projection portion for releasable secured connection with a pair of jaws of a vibrator, the top portion having a pair of opposed downwardly-extending slots to permit insertion of a pair of opposed sides of the module, the top portion also containing a fluid inlet into the fluid conduit; the bottom portion of the mandrel securedly positioned on a bottom of the at least one of the opposed pair of connected sides of the mandrel and having an egress opening for the fluid conduit, the bottom portion extending beyond a length of the U-shaped channel of the retaining wall module; affixing a source of pressurized fluid to the fluid inlet of the top portion of the mandrel; affixing the vibrator to the upwardly-extending projection portion by engagement of the upwardly-extending projection with the pair of jaws of the vibrator; positioning the module for insertion into a location; ejecting pressurized fluid through the egress opening for the bottom portion of the fluid conduit while vibrating the mandrel to allow penetration of the U-shaped channel and mandrel into the location.

The process further includes a step wherein the pressurized fluid is selected from the group consisting of compressed gas and pressurized liquid, more preferably the compressed gas is air and the pressurized liquid is water. Often, the fluid inlet into the fluid conduit is a 90° elbow.

The process still further includes the use of pressure wherein the pressurized fluid is at least approximately 50 psig when the fluid is a gas, and wherein the pressure of the pressurized fluid is at least approximately 5 psig when the fluid is a liquid, although it is noted that the pressures associated with fluid are quite variable and extend across a wide range.

In the process, the bottom portion of the mandrel is preferably either beveled or tapered, although it may be flat depending upon various soil conditions encountered at the installation site.

The process further includes the step of filling each module with concrete. During the step of positioning the module for insertion into a location includes the addition of at least one second module to the first module by sliding mating engagement of a male projection into a female receiving channel. The process may be repeated to include at least one third module by sliding mating engagement of a male projection into a female receiving channel.

Optionally, the process optionally includes adding a pair of opposed and connected weep holes into at least one module to permit draining from an uphill ground location to a water location, the weep hole on the water side of the module positioned above a water line.

While a U-shaped module is described, there is no need to limit the invention to such, and internal mandrels of the instant invention may be employed to install closed polygon-shaped modules in a manner similar to that described above.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

DETAILED DESCRIPTION OF THE INVENTION

The best mode for carrying out the invention will now be described for the purposes of illustrating the best mode known to the applicant at the time of the filing of this invention. The examples and figures are illustrative only and not meant to limit the invention, as measured by the scope and spirit of the claims.

Unless the context clearly indicates otherwise: the word "and" indicates the conjunctive; the word "or" indicates the disjunctive; when the article is phrased in the disjunctive, followed by the words "or both" or "combinations thereof" both the conjunctive and disjunctive are intended.

As used in this application, the term "approximately" is within 10% of the stated value, except where noted.

Figure 1:
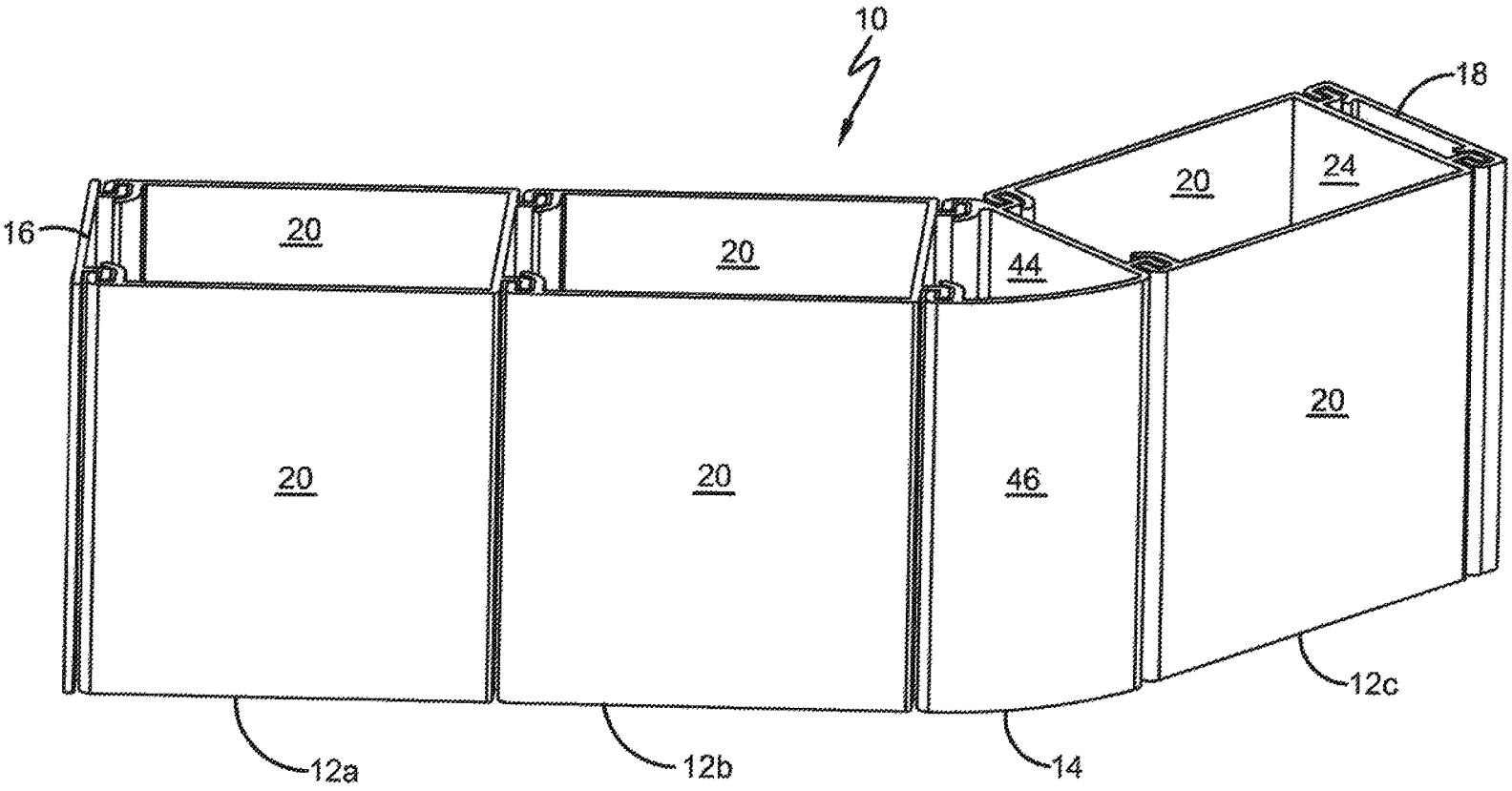
FIG. 1 is a perspective view of the modular retaining wall illustrating a 450 bend interposed therein with end caps positioned at opposed ends of the wall.

As better illustrated in FIG. 1, retaining wall 10 consists of various modules which form a contiguous barrier wall across a length of the modules when in their assembled state. Some modules are essentially interlocking linear U-shaped channels, e.g., 12*a*, 12*b*, and 12*c* whereas other interlocking modules, e.g., angled module 14, are used to impart non-linearity to the wall. As illustrated in the figure, the imparted angle is approximately 45°, although this is but an example of any angle between 1° and 180°, the end-use application, which in an aqueous environment will be the shoreline defining the requisite angularity required for the non-linear modules. The combination of linear U-shaped modules with non-linear modules provides essentially limitless geometries for retaining wall 10. At each end of the wall, is an end-cap 16, 18 with an appropriate geometry so as to interlock or mate with its adjacent module, whether that module is linear or angled.

Figure 2:
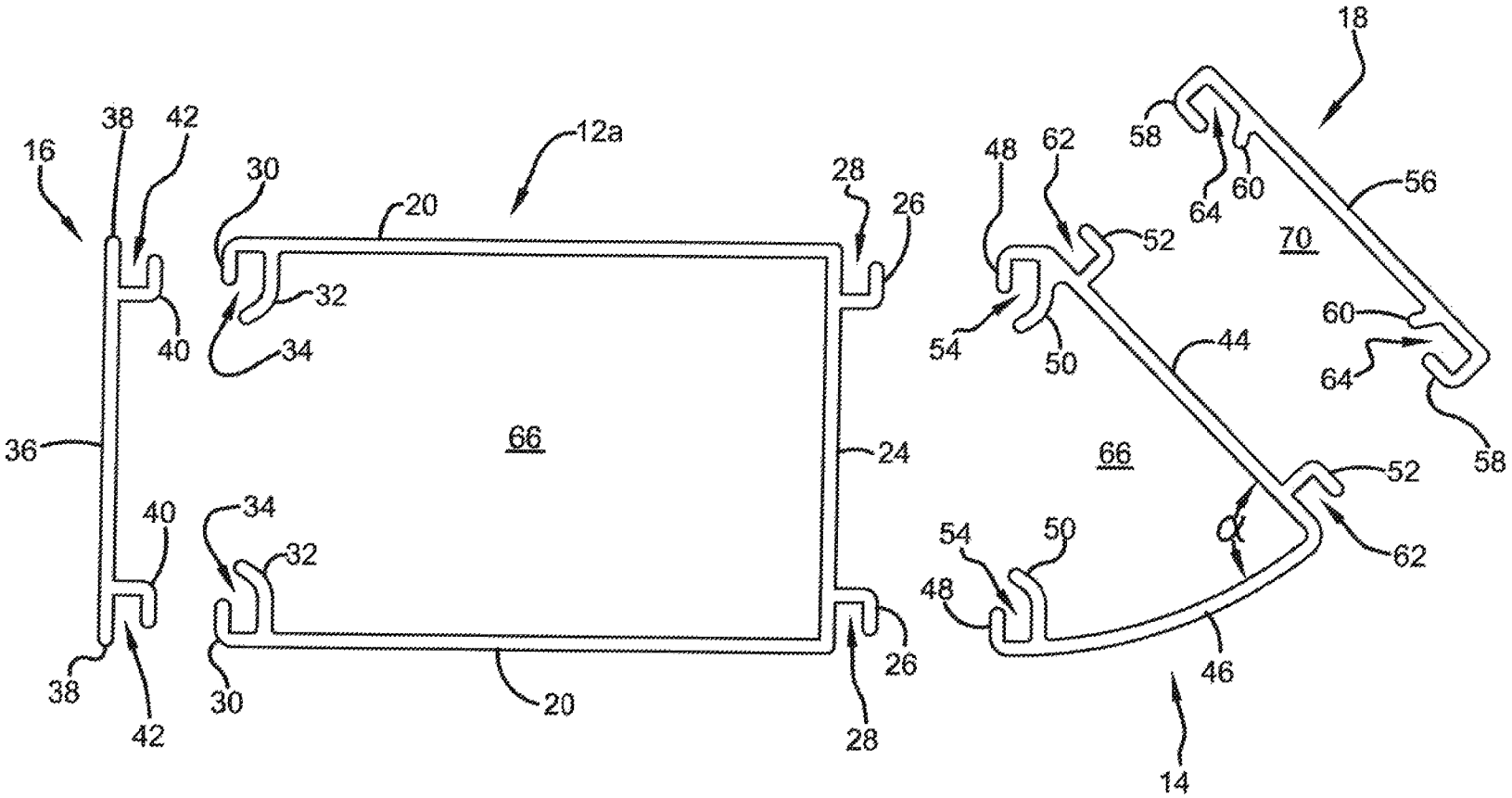
FIG. 2 is a top plan view of one module of FIG. 1.

As better illustrated in FIG. 2, a combination of one linear U-shaped channel module 12*a* with adjacent angled channel 14 with respective end caps 16, 18 is shown in an unassembled state. Linear module 12*a* is comprised of a pair of essentially parallel vertically-extending sides 20 in connected engagement with an essentially vertical third side 24 positioned normal to the vertical plane of sides 20 at one end of each side 20 forming an essentially open "U-shaped" channel 66 within module 12*a*. Affixed to the exterior of third side 24 and positioned interiorly of each of the ends of the side, is a pair of outwardly facing "J-shaped" or "U-shaped" hook protrusions 26 defining an open longitudinal channel 28. Affixed to each end of lateral sides 20 at the open end of U-shaped channel 66 are a pair of inwardly facing end wall segments 30. Spaced apart from end wall segments 30 and penetrating inwardly and curvilinearly toward the open end of the channel are interior curvilinear wall segment protrusions 32, the combination of end wall segments 30 and interior curvilinear wall segment protrusions 32 defining open vertically-extending longitudinal channel 34. While curvilinear wall segments 32 are defined as curvilinear, in an alternative embodiment, these segments could be intersecting linear segments, the end-use application defining the need for a geometry which is either curvature-based or intersecting perpendicular line based in a manner similar to that defined for outwardly-facing J-shaped hooks 26.

In constructing retaining wall 10, either a second linear U-shaped channel module 12*b* is attached to the first linear U-shaped channel module 12*a* or a non-linear or angled module 14 is affixed through mating channels and protrusions. As illustrated in FIG. 2, a non-linear module 12*b* is shown adjacent to the closed end of linear U-shaped module 12*a*. This angled module, shown to produce an angle of approximately 30°, although both larger and smaller angles are within the scope of this invention, ranging from 1° to 180° are envisioned. Angled module 14 is essentially J-shaped or hook-shaped in which side 44 and curvilinear or curved side 46 intersect, the degree of curvature defined by an angle a (shown to be approximately 45° in the Figure) formed by the intersection of the vertical plane of side 44 and the vertical plane of curvilinear side 46. In a manner analogous to that discussed with vertical third side 24 of linear module 12*a*, and affixed to the exterior of side 44 and positioned interiorly of each of the ends of this side, is a pair of outwardly facing "J-shaped" hook protrusions 52 defining an open longitudinal channel 62. Affixed to non-intersecting end of side 44 at the open end of open triangular shaped channel 68 and to non-intersecting end of curvilinear side 46 at the same open end of channel 68 is a pair of inwardly facing end wall segments 48. Spaced apart from end wall segments 48 and penetrating inwardly and curvilinearly toward the open end of the channel are interior curvilinear wall segment protrusions 50, the combination of end wall segments 48 and interior curvilinear wall segment protrusions 50 defining open longitudinal channel 54. While curvilinear wall segments 50 are defined as curvilinear, in an alternative embodiment, these segments could be intersecting linear segments, the end-use application defining the need for a geometry which is either curvature-based or intersecting perpendicular line based in a manner similar to that defined for outwardly-facing J-shaped hooks 26.

Attachment of angled module 14 to a linear module, e.g., 12*a* or 12*b* or 12*c*, is effected by mating engagement of male J-shaped hook protrusion 26 into open female longitudinal channel 54 formed by end wall segments 48 and curvilinear segments 50. By having mating engagement occur with two channels simultaneously, the modules become self-aligning.

Retaining wall 10 is constructed by matingly securing linear U-shaped modules 12 and angled modules 14 in combination to meet the geometry required by the end-use application. It is recognized that since the modules are mirror images when dissected through a horizontal plane, that the direction of the turn of the retaining wall through the utilization of an angled module can be in either direction by simply turning the angled module upside-down. At either end of the retaining wall, is an end cap, the configuration of which is dictated by whether the end cap is designed to close an open U-shaped channel or to mate with a pair of outwardly facing J-shaped hooks. In FIG. 2, channel closing end cap 16 is constructed with side 36 essentially parallel to third side 24 at the closed end of channel 66. Spaced inwardly and interiorly of each opposed end 38 of the end cap is a pair of outwardly facing "J-shaped" hook protrusions 40 defining an open longitudinal channel 42. Attachment of channel closing end cap 16 with linear module 12*a* occurs via mating engagement of male J-shaped hook protrusion 40 into female longitudinal channel 34 formed by end wall segments 30 and curvilinear segments 32. At the opposed end of retaining wall 10 from channel-closing end cap 16 is terminating cap 18 having a side 56 with a pair of inwardly facing J-shaped hooks 58 at each end with a pair of inwardly facing fingers 60 spaced apart and inward from the pair of J-shaped hooks. Attachment of terminating end cap 18 with angular module 14 occurs via mating engagement of male J-shaped hooks 52 into open female longitudinal channels 64 formed by J-shaped hooks 58 and inwardly facing fingers 60 thereby closing and simultaneously forming channel 70 between side 56 of terminating end cap 18 and side 44 of angled module 14.

Figure 3:
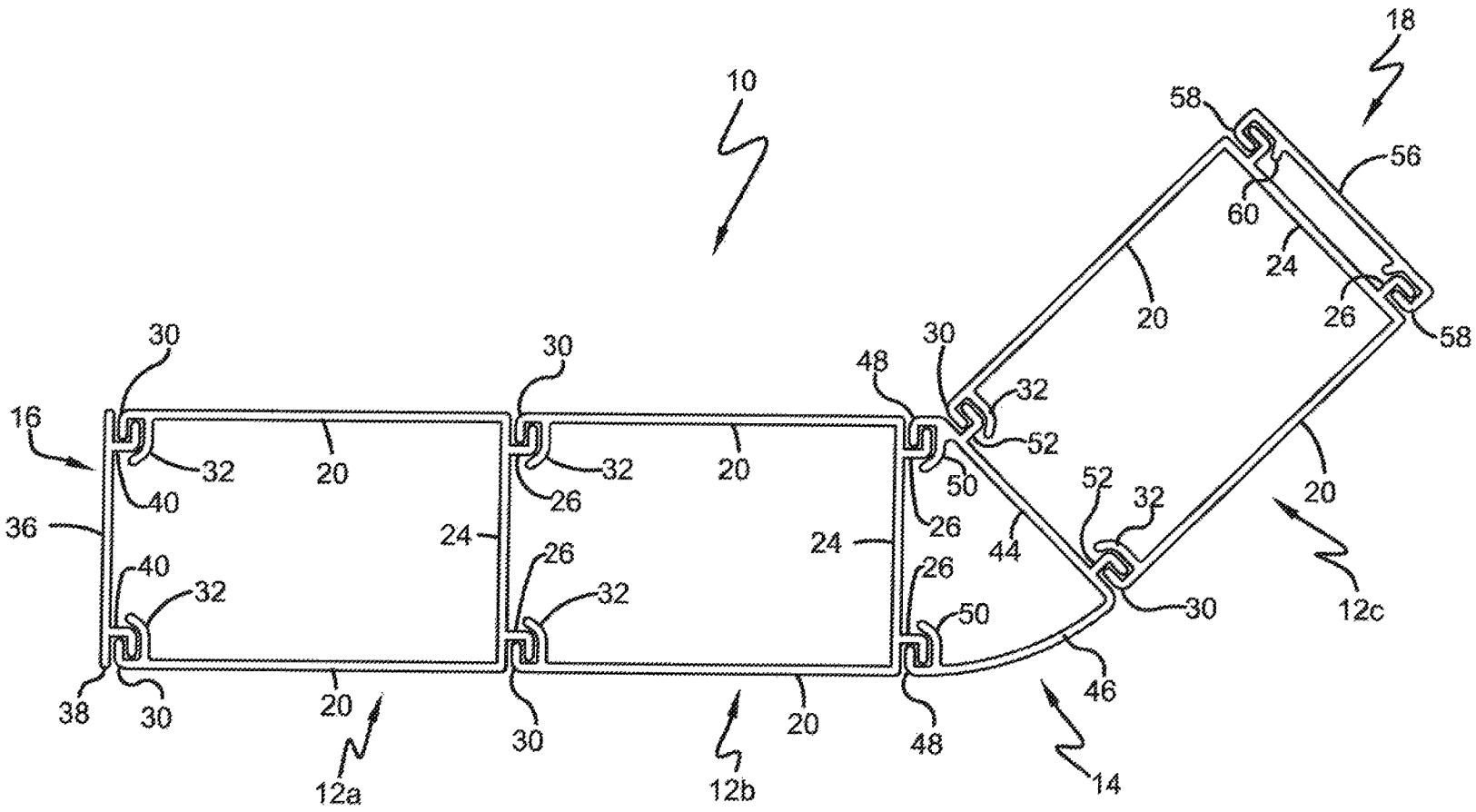
FIG. 3 is a top plan view of FIG. 1.

As illustrated in FIG. 3, terminating end cap need not be affixed to angled module 14, but rather could also terminate a linear U-shaped channel module 12*c*. Attachment of terminating end cap 18 with linear module 12*c* occurs via mating engagement of male J-shaped hooks 26 into open female longitudinal channels 64 formed by J-shaped hooks 58 and inwardly facing fingers 60 thereby capping retaining wall 10.

Figure 4:
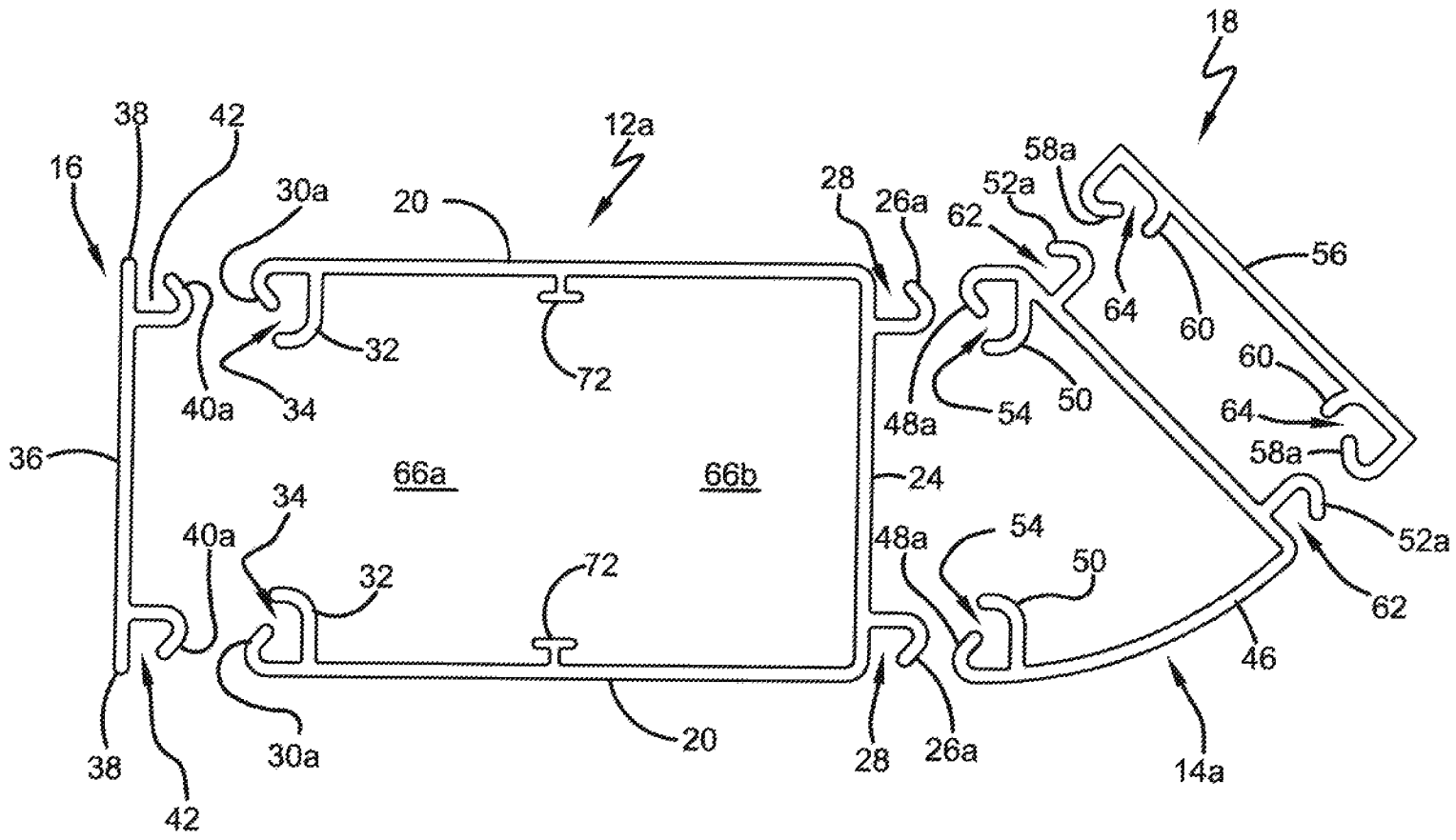
FIG. 4 is a top plan view of an embodiment of the modular retaining wall illustrating the incorporation of a middle retaining rib and a different linking geometry.
Figure 5:
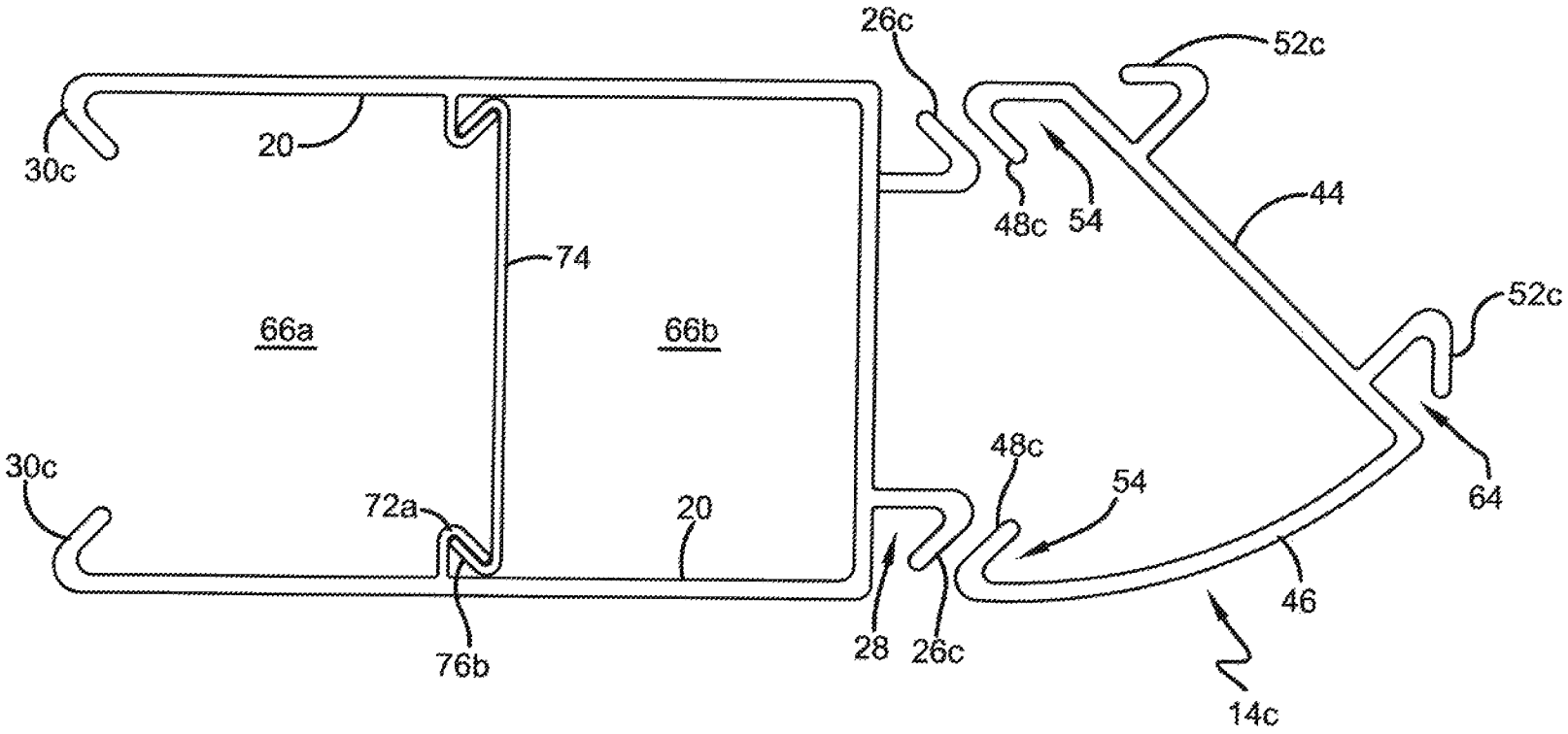
FIGS. 5-7 are top plan views of alternative embodiment of the modular retaining wall illustrating alternative linking geometries including middle side wall support.
Figure 6:
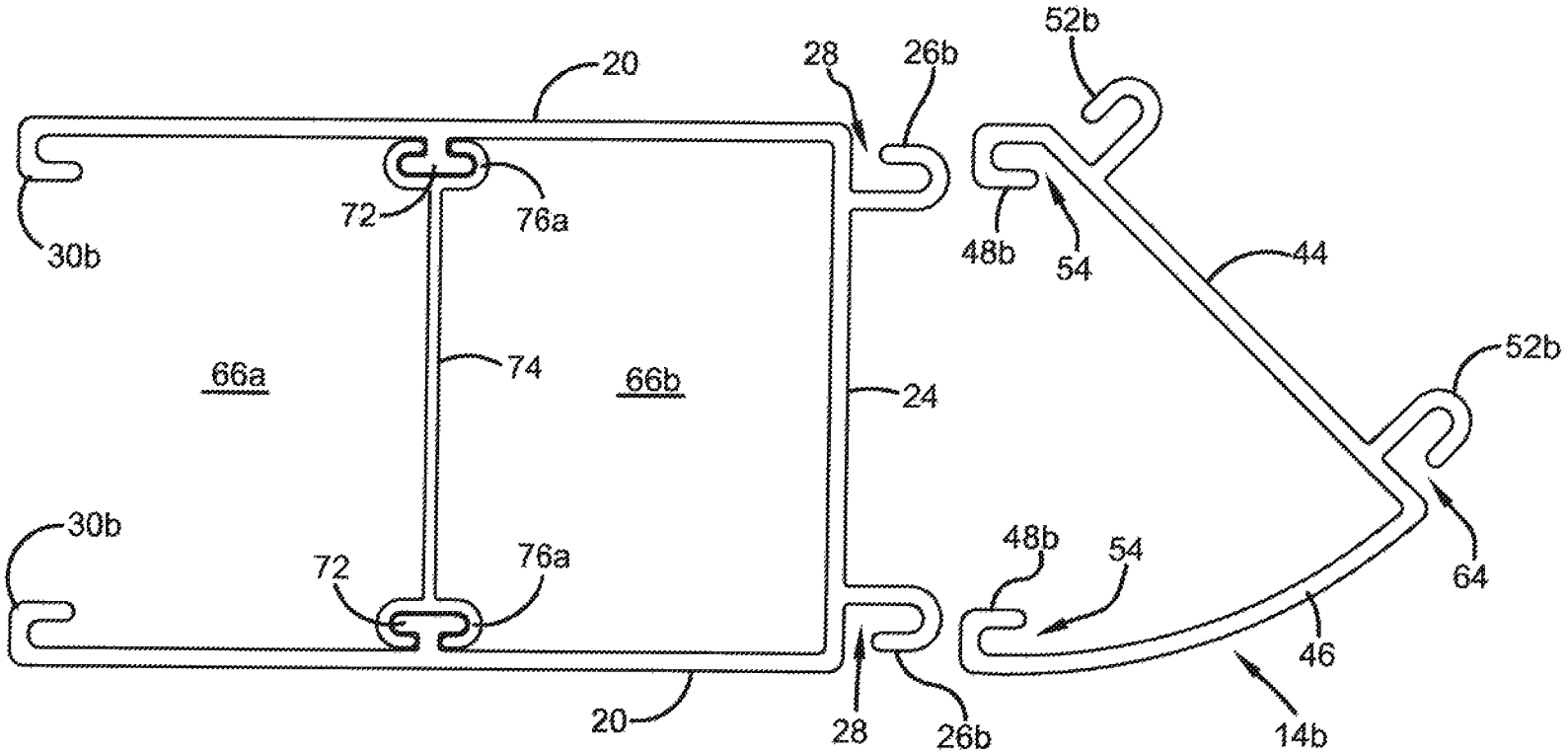
Figure 7:
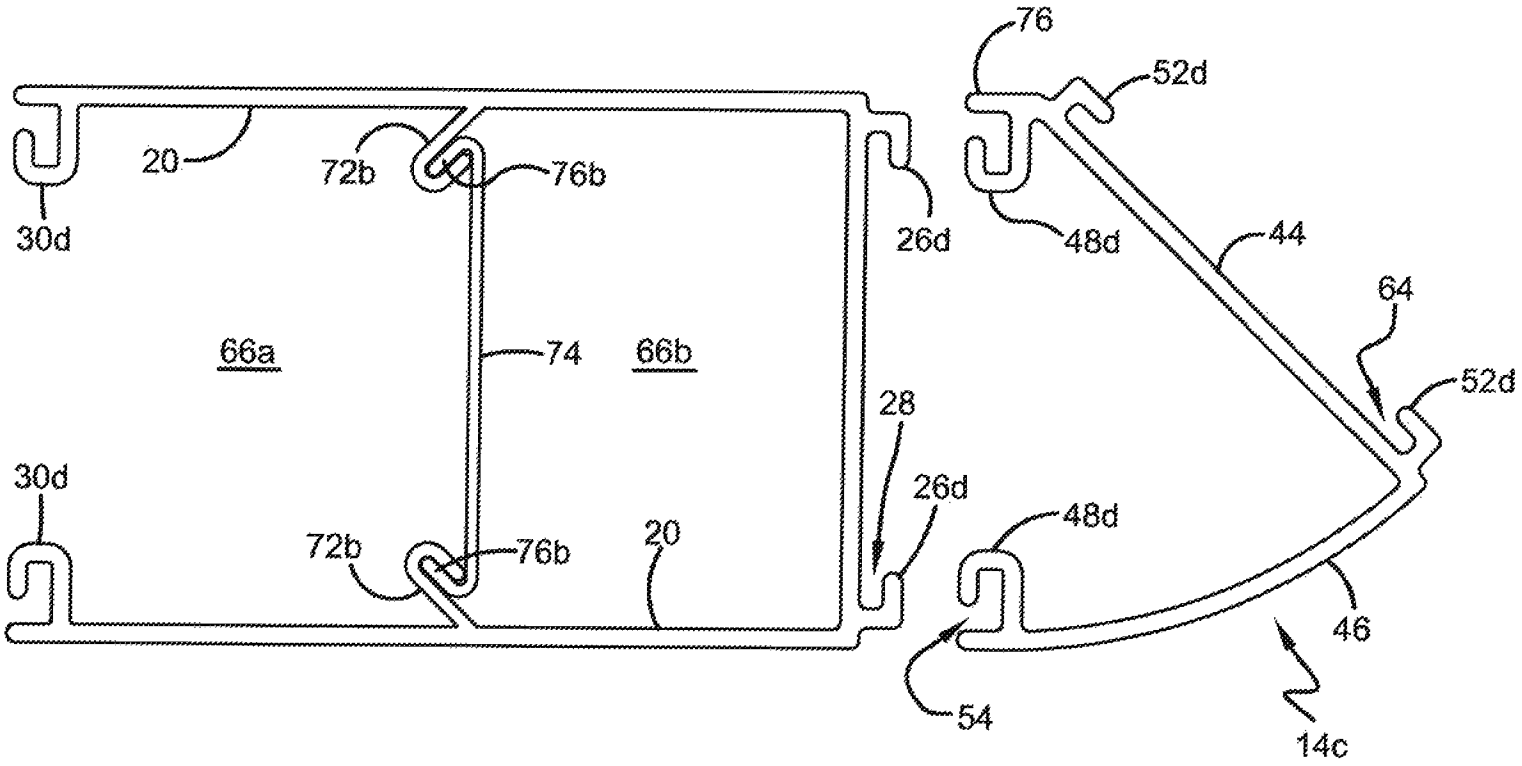

As used in the field and in a preferred embodiment only, after driving the modules into the seabed using mechanized driving equipment, each closed cavity which is formed through mating engagement with a subsequent module, is filled with pea gravel or more preferably, concrete or even combinations thereof. The filling operation creates outward lateral pressure on each module. For those modules which have relatively small horizontal dimensions, the inherent structural strength of the walls of the module are sufficient to resist any lateral bowing of the module. However, for those modules which have a larger horizontal dimension, e.g., 12*a*, 12*b*, 12*c* in the Figures, it is often desirable to include T-shaped (or other geometried) male anchors 72 positioned on opposing side walls 20 on the inside of cavity 66, thereby forming two separate cavities, 66*a* and 66*b*. This lessens the tendency of the larger modules to lateral bowing when the male anchors 72 are in mating engagement with at least one rib 74 (better illustrated in FIGS. 5-7) which are in mating engagement with the male anchors While a pair of T-shaped male anchors 72 are illustrated in FIGS. 4, 6 and shown to be in engagement with a rib 74 having a pair of open oval channels 76*a* positioned at each end of the rib for mating engagement with the male anchors, there is no need to limit the invention to this geometry. As illustrated in FIGS. 5, 7, reinforcing rib 74 can mate with male anchors 72*a* (inwardly facing bent finger positioned normal to the vertical plane of wall 20) or 72*b* (inwardly facing bent angular finger). When in either of these geometries, it is important that the geometry of the opposed ends 76*b* of reinforcing rib 74 successfully mate or securely or lockingly engage with the male anchor.

As illustrated in FIGS. 4-7, each of the modules can have mating attachment locking mechanisms which employ slightly different geometries, and the invention is not limited to any one geometry. For example, inwardly facing wall segments 30 may be geometried as inwardly facing J-shaped hooks 30*b* which bend backwards 180°, or as inwardly facing J-shaped hooks 30*c* which form an acute angle with wall 20, said angle ranging from 1-90°, or as outwardly-facing J-shaped hooks 30*d*. Additionally J-shaped hooks 26 may be geometries as outward-facing J-shaped hooks 26*a* which form an acute angle to the initial normal projection from third end wall 24, said angle ranging from 1-90°, or outward-facing J-shaped hooks 26*b* which bend backwards 180°, or outward-facing J-shaped hooks 26*c* or inward-facing hooks 26*d*. Similarly, inwardly-facing wall segments 48, namely 48*a*, 48*b*, 48*c* or 48*d* may be possessed of different geometries, the key being mating or secure or locking engagement with their corresponding J-shaped hooks 26. Similar comments are pertinent to protrusions 52, namely 52*a*, 52*b*, 52*c*, and 52*d* which would need to correspondingly securely or matingly engage with their associated next modular unit.

Figure 8:
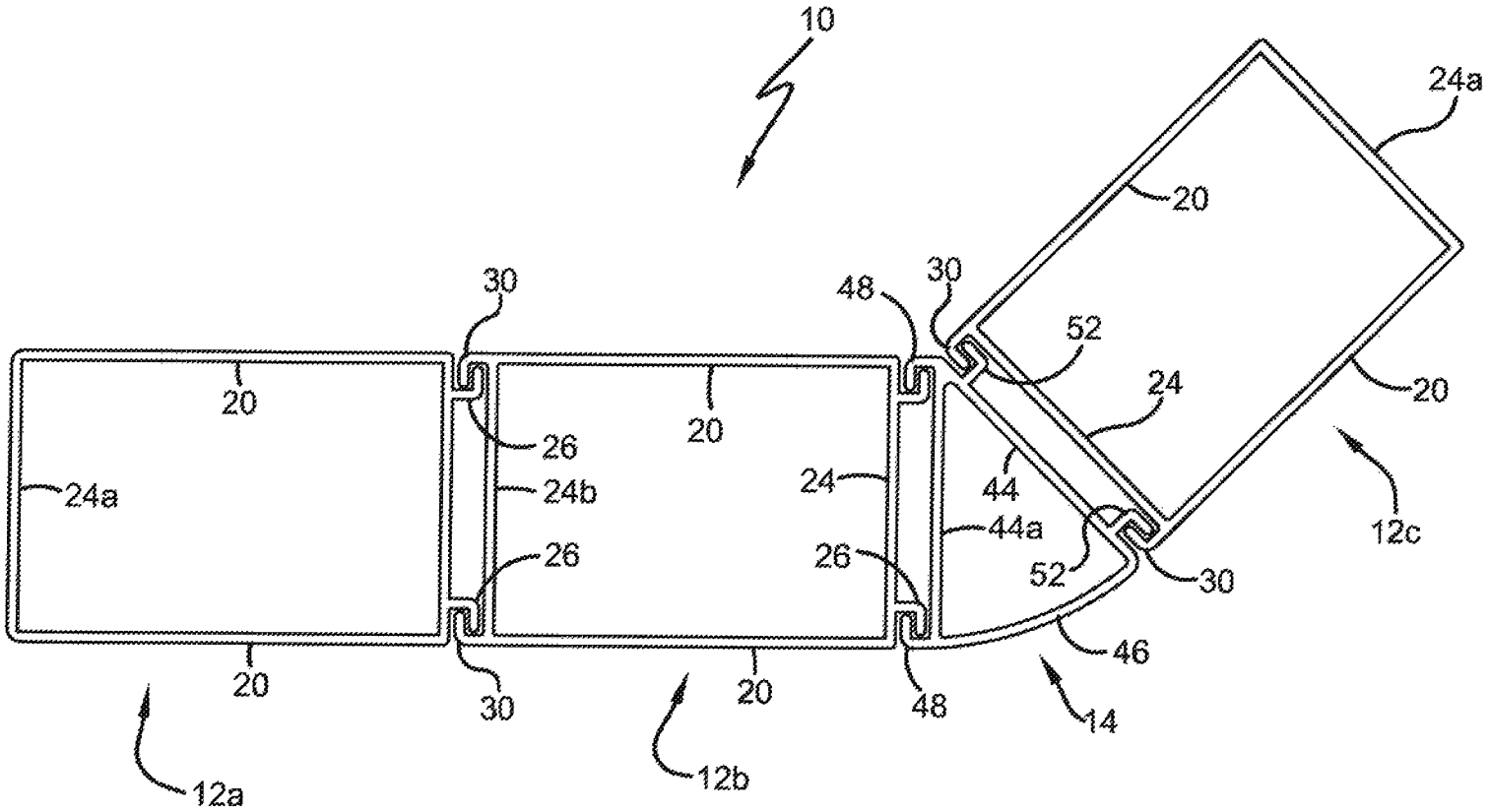
FIG. 8 is a top plan view of closed polygonal shaped modules for use in an embodiment of the retaining wall.

FIG. 8 illustrates a further embodiment of the modular retaining wall construction wherein each module is of a closed geometry for additional stability if required by the application. Module 12*a* comprises a closed rectangular polygon having a pair of parallel sides 20 and a pair of connecting ends. End 24*a* simply closes the polygon on one side and is used as a terminating end module to the retaining wall 10. When used in this configuration, there is no need for end cap 36 as illustrated in FIG. 3 for example. Opposed end 24 has a pair of outwardly-facing male J-shaped hook protrusions 26 for engagement with inwardly-facing J-shaped hooks of inner module 12*b*. This module is the building block module when the wall is constructed with closed polygon modules. Module 12*b* comprises similar parallel sides 20 with opposed end walls, one end wall having a pair of inwardly-facing J-shaped hooks 30 while opposed end 24 has a pair of outwardly-facing J-shaped hooks. Construction of the retaining wall includes linking as many modules 12*b* as is necessary until the wall either ends or is angled. When angularity is required to the construction of the wall, a closed triangular-shaped module is added to end 24 of module 12*b* through gripping or securing engagement of outwardly-facing J-shaped hooks 26 with inwardly-facing J-shaped hooks. Completion of a modular retaining wall is effected by the attachment of module 12*c*, a module similar to 12*a* with the exception that the securing fingers are inwardly-projecting J-shaped hooks 30 in contrast to the outwardly-facing J-shaped hooks 26 of module 12*a*.

Figure 9:
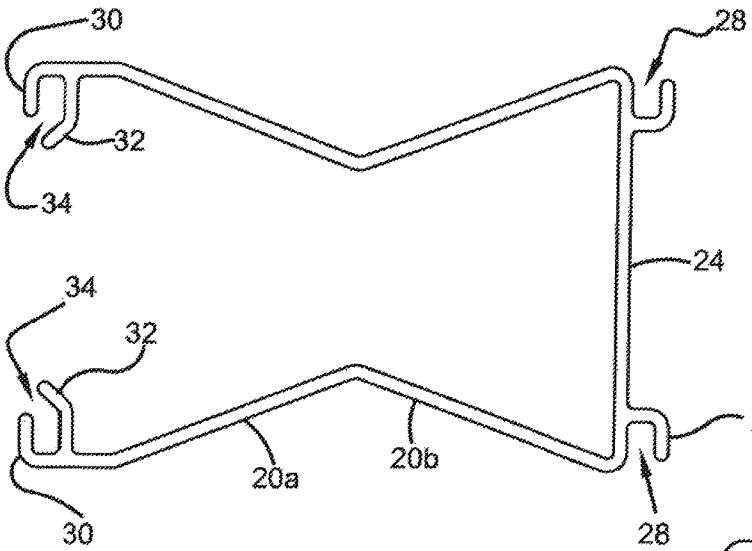
FIG. 9 is a top plan view of an end or middle module of the modular retaining wall illustrating the open polygon shape.
Figure 10:
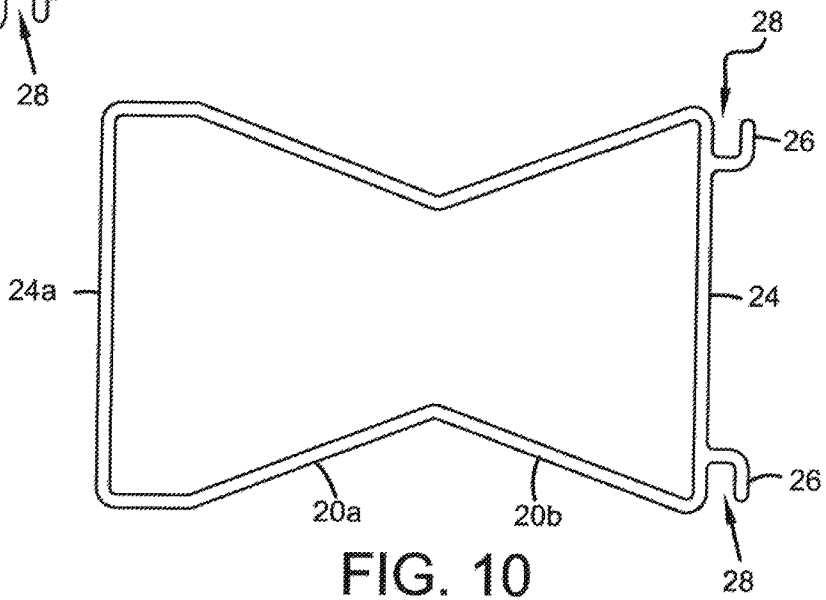
FIG. 10 is a top plan view of an end module of the retaining wall illustrating the closed polygon shape.
Figure 12:
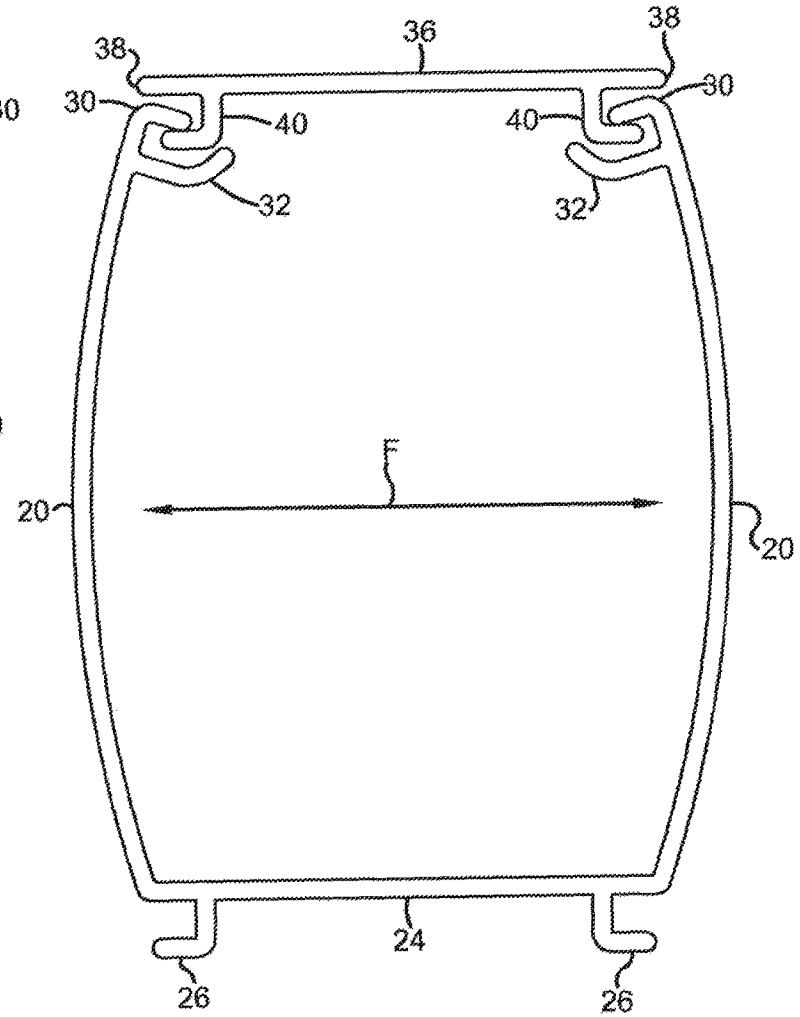
FIG. 12 is an expanded top plan view of the module of FIG. 11 illustrating the application of an outward force (F) in the middle of the module, typically due to filling with pea gravel and its associated impact and movement on the joint illustrating partial disengagement.
Figure 18:
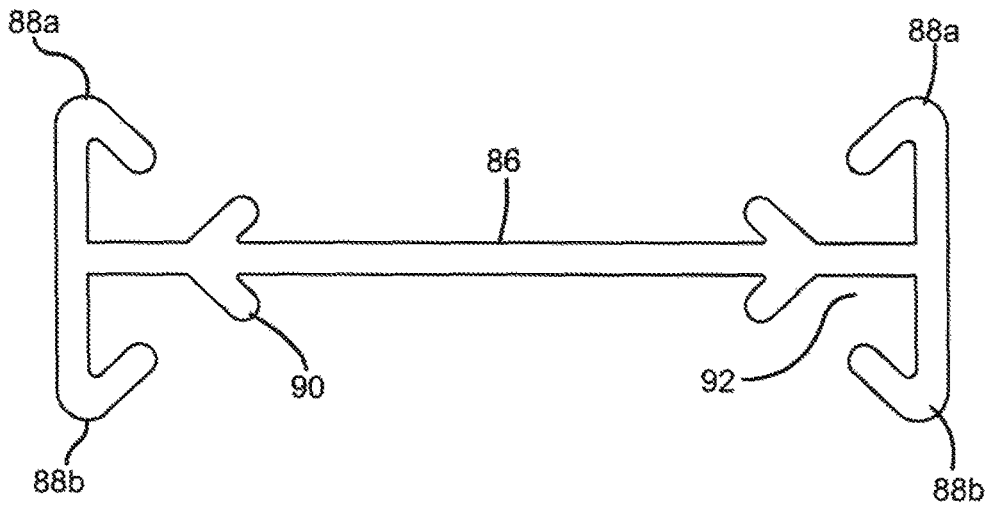
FIG. 18 is a top plan view of a reversing connector.

While the invention has been described in terms of open U-shaped modules and closed rectangular modules for the essentially linearly oriented modules, there is no need to limit the shape of the modules to such. In fact, as illustrated in FIGS. 9-10, both open and closed polygons are useful in the invention. As shown particularly in FIG. 9, end 12*a* or middle module 12*b* which was illustrated to be an open U-shaped three-sided polygon, may be envisioned as an open seven-sided polygon, wherein side panel 20 has been modified by inwardly-positioned side panels 20*a* and 20*b*. It is noteworthy that the apex of side panels 20*a* and 20*b* need not be equally spaced between bottom side 24 and end cap 36, but may be positioned off-center. It is also noted that the length of side panels 20*a* and 20*b* need not be equal. In a similar manner, this concept may be extended to the closed polygons which were originally shown to be rectangular in FIG. 8, but are illustrated to be polygonal in FIG. 10. This concept may equally be extended to the non-linearly oriented modules, e.g., 14. Of note is that when constructing a seawall, it is possible to reverse the orientation of the modules, whether open or closed polygonal by the use of a reversing connector as illustrated in FIG. 18 having a cross member 86 with pair of oppositely facing inwardly projecting fingers 88*a*, 88*b* which form a channel 92 with protruding finger 90. The reversing module is affixed to an end of a seawall module.

Figure 19:
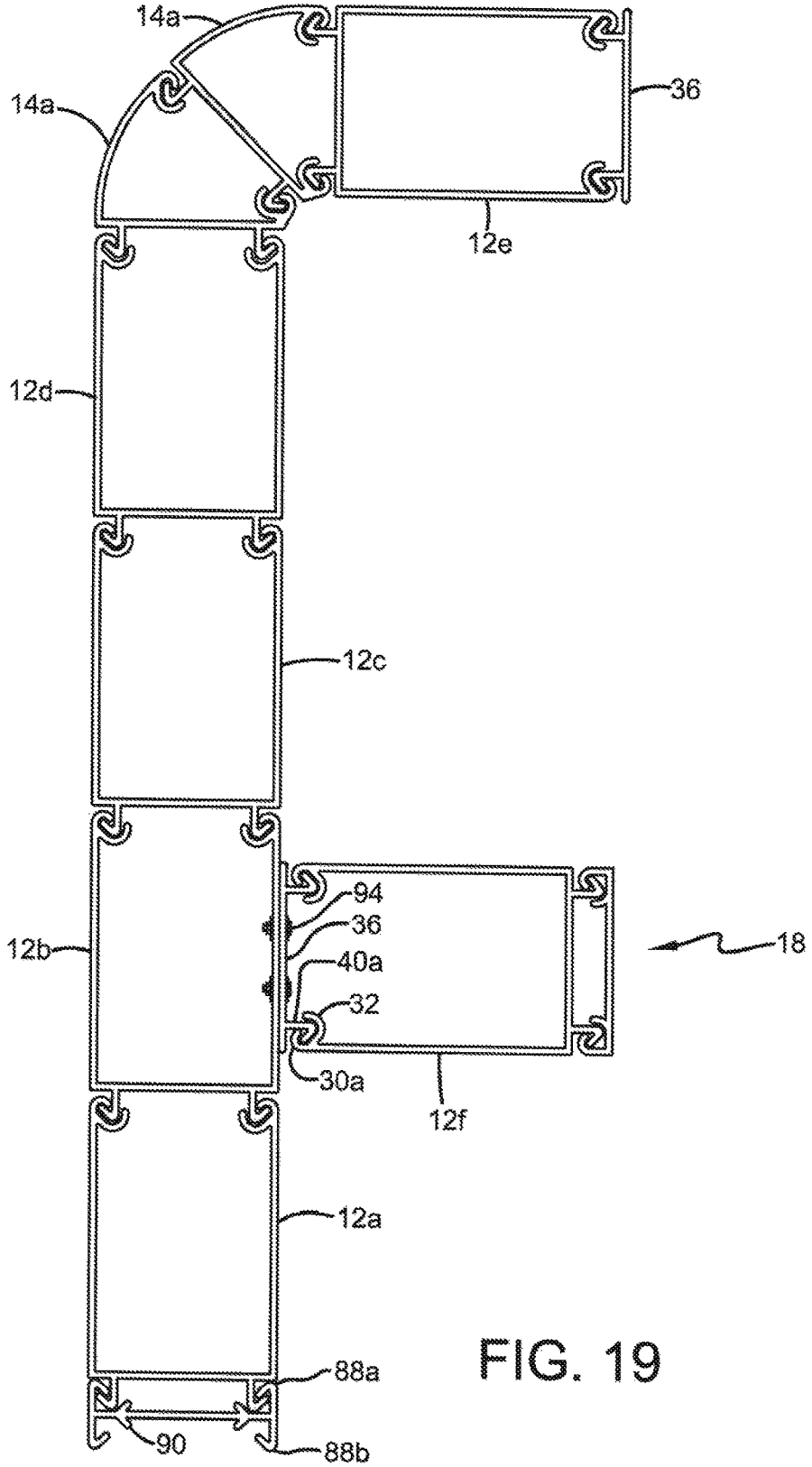
FIG. 19 is a top plan view illustrating curved sections, bolted add-on sections; and a reversing connector.

Shown in combination with other modules is the seawall illustrated in FIG. 19 in which U-shaped modules 12*a*, 12*b*, 12*c* and 12*d* are affixed in longitudinal linear alignment, with side wall module faces being essentially in planar arrangement, with minimal indentations at the joints. This is important in that minimizing indentations simultaneously minimizing eddying, which is a contributing factor in generating noise in tidal areas. Non-linear open modules 14*a* enable the wall to be bent at essentially a 45° angle, which in combination, can be joined to make angles of 90°, 135° and 180° with the option of attaching further modules e.g., 12*e* to the open end of the angled module with end cap 36. Obviously, by choosing a different angle of bend, e.g., 30°, it is possible to fabricate modules with different degrees of angularity, thereby making different amounts of bend in the wall. Additionally, by reversing the angled modules, it is possible to provide a more serpentine look to the wall, still maintaining the essentially contiguous vertical and horizontal planarity look to the wall even across the joints, this contiguity of look extending across even non-linear modules, e.g., 14*a*. For those instances where more than one seawall leg is desired, this "custom" build-on can be achieved by attaching an end cap 36 to side wall of one of the modules, e.g., 12*b* by at least one, preferably two fastening means 94 illustrated in FIG. 19.

In one aspect of the invention, the construction of a seawall is that the joints utilized to construct the seawall of the current invention are not intended to be essentially leak-tight. This is often the case when the retaining wall modules are filled with pea gravel, and not concrete. In that instance, a certain amount of fluidity or non-contiguous contacting engagement is desired to allow water (or liquids or other fluids) the ability to flow from the land side of the seawall into the water-contacting side. Phrased alternatively, there is a contiguous fluid path across the module, which encompasses water flowing through the joints. The value of this resides in the fact that after heavy rainfalls, when pools of water form on the land side, the accumulated water can flow through the joints and water removal does not have to rely strictly upon soil permeation and/or evaporation for removal, but can additionally incorporate flow through the seawall joints.

Figure 11:
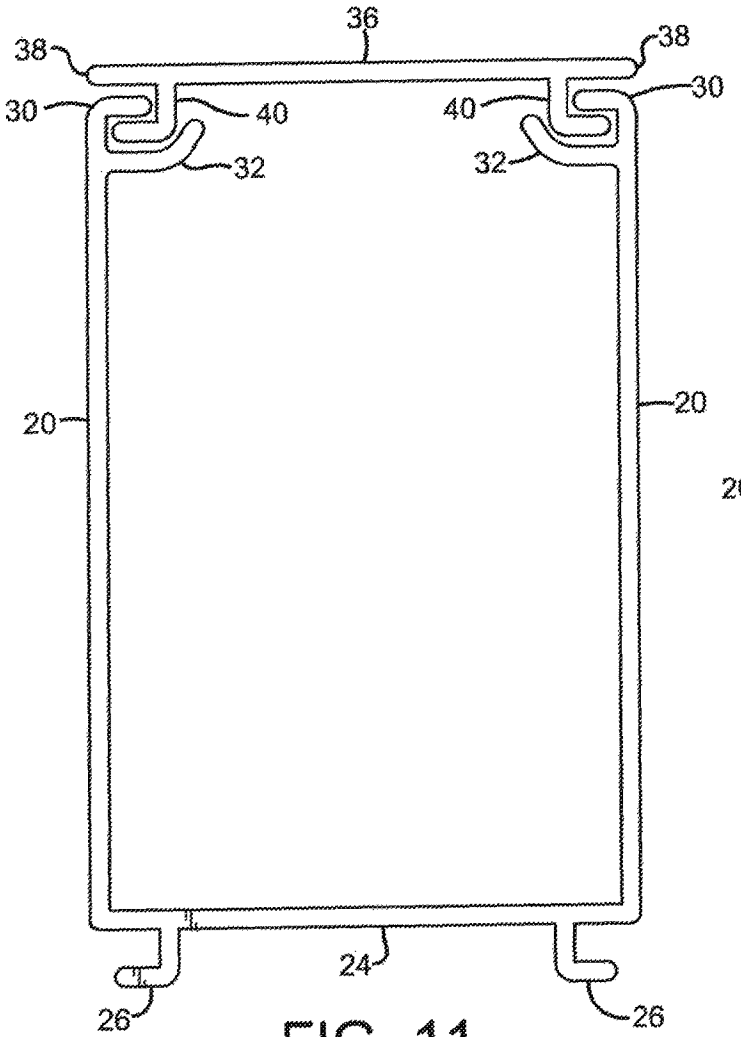
FIG. 11 is an expanded top plan view of an end module of the retaining wall illustrating the fastening of the end module with an open polygon shape with areas of non-contiguous contact or gaps in the joint to allow water or other fluid egress from one side of the wall to the opposite side.
Figure 13:
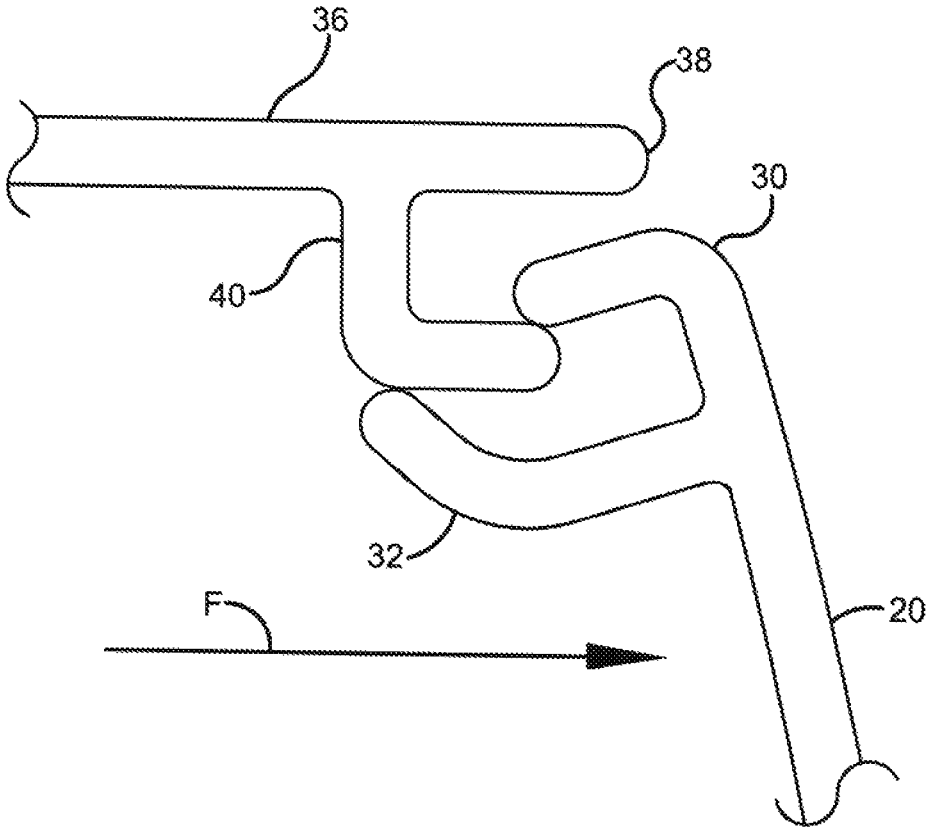
FIG. 13 is an exploded top plan view of one joint of FIG. 12 upon continued application of a lateral outward force (F) and its associated impact on the joint, illustrating the joint becoming dislodged.
Figure 15:
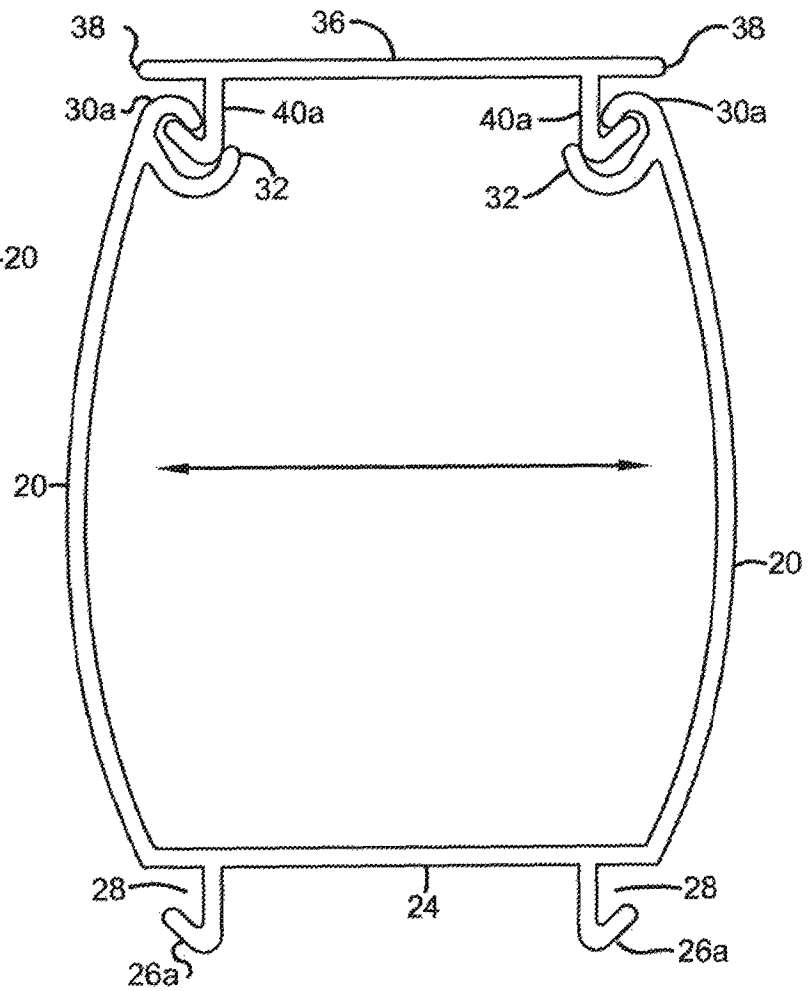
FIG. 15 is an expanded top plan view of the module of FIG. 14 illustrating the application of a laterally expanding outward force (F) in the middle of the module in a manner similar to FIG. 12, and its associated impact on the joint, illustrating the joint becoming more tightly engaged rather than becoming dislodged as illustrated in FIG. 13.
Figure 17:
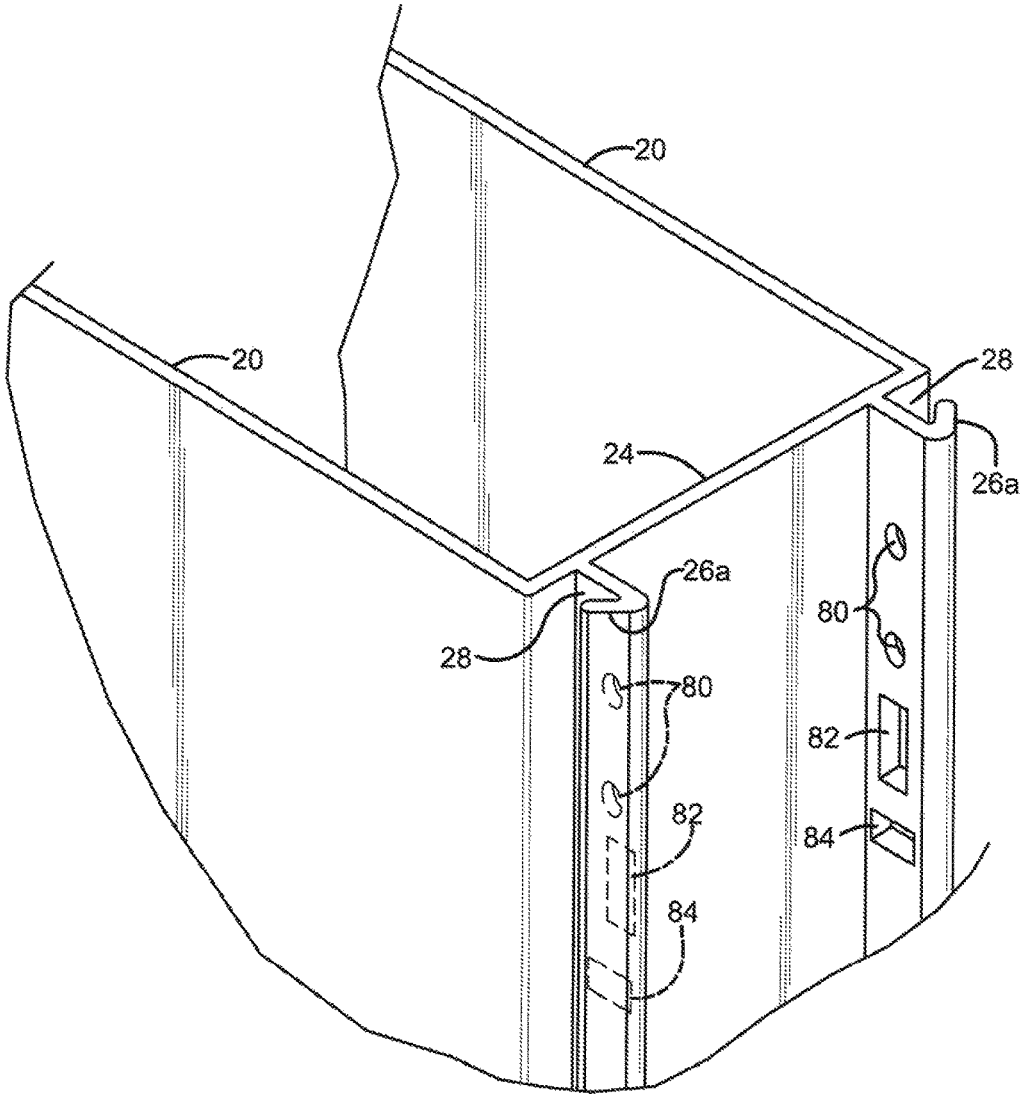
FIG. 17 is an enlarged perspective view of one end of the module illustrated in FIG. 14 showing apertures within an extending finger.
Figure 20:
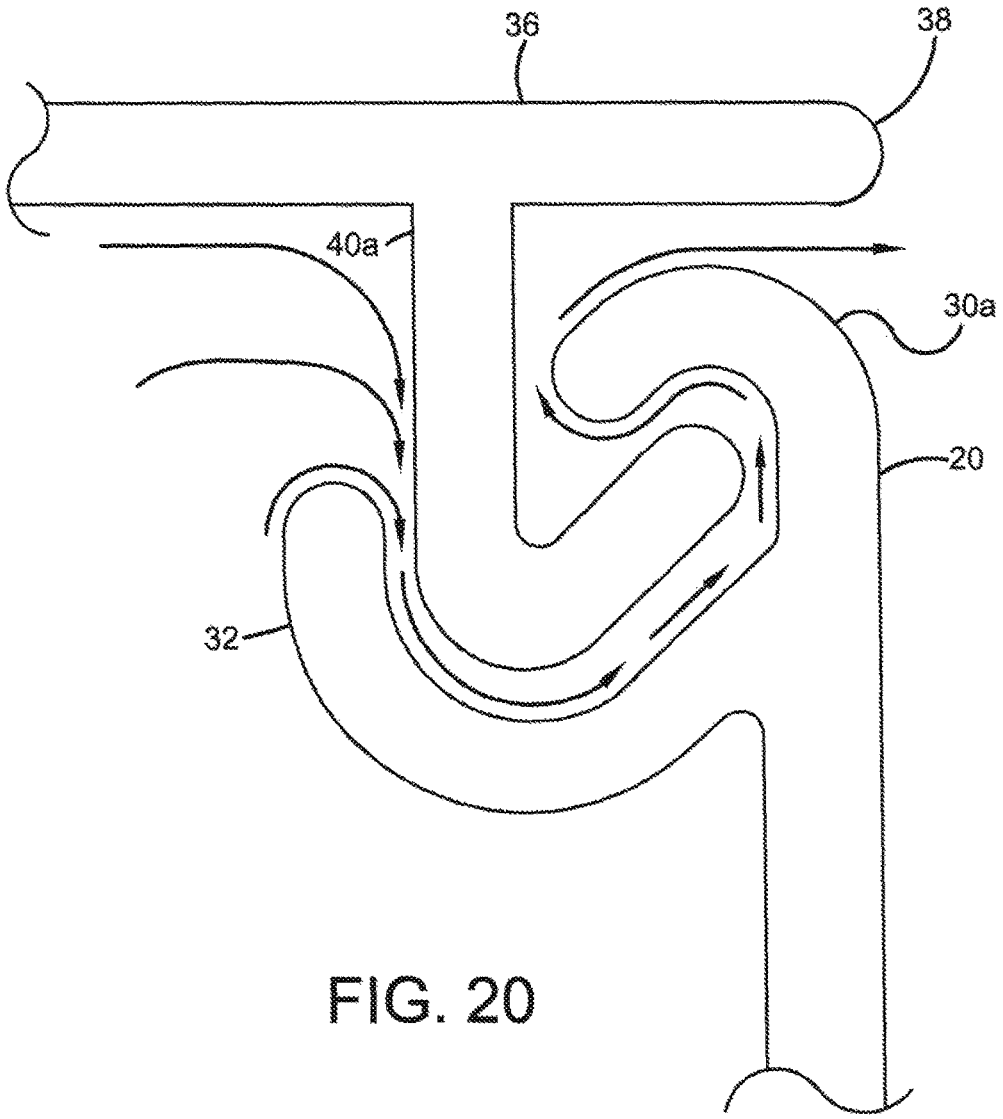
FIG. 20 is an enlarged view illustrating a fluid flow pattern through one mating J-shaped joint applicable when using a granular filler material within the channels, and not applicable when using a solid filler material such as concrete.

This additional flow can be achieved in two complementary approaches. The most common is through the design of the joints themselves, through geometric dimensional control which allows for a non-tight fit of the mating fingers of the joints. As illustrated in FIG. 11, inwardly projecting fingers 30, 32 create a vertical channel into which outwardly projecting finger 40 interfaces and mates and joins in a manner in which there is non-contiguous contact along the entire length of the channel, shown in an idealized manner in the figure where essentially equal spacing is illustrated as a gap between the exterior surfaces of the fingers. In a more typical environment, and considering the fact that these modules are pounded into the seabed, it is more likely that some, but not all portions of the exterior of the fingers will be in contacting engagement at different points along the vertical channel within which outwardly facing finger 40 penetrates. Similarly, as better illustrated in FIG. 14, outwardly projecting finger 40*a* within vertical channel 42, created by inwardly projecting fingers 30*a* and 32, is in contacting engagement with only a portion of channel 42. In either figure, water is able to move from one side of the module to the opposed side due to the fact that there is no complete sealing of any surface interposed between the opposed sides of the modules. Alternatively, it is possible to position at least one aperture 80, 82, 84 in at least one vertically extending support or finger 26*a* to allow for water flow as illustrated in FIG. 17. This aspect of the invention may be better illustrated in FIG. 20, in which the arrows indicate a stylized depiction of one possible direction of fluid flow through a joint of the seawall. As illustrated in that figure, each mating pair of fastening means is the combination of two essentially parallel, essentially vertical surfaces, the adjacent surfaces having a gap between at least a portion of the respective vertical surfaces to allow fluid flow therebetween. Therefore, while the surfaces are essentially parallel and adjacent, due to the inherent imperfections in the extrusion process, they are not mirrored surfaces, which might prohibit fluid flow.

As illustrated in all the Figures, each seawall module is a self-supporting structure that can be driven into the seabed using a vibratory hammer or another appropriate device. Considering this requirement, the thickness of the module, typically constructed of PVC is dependent upon the amount of resistance anticipated to be encountered during installation as well as the number of type of fillers added to the PVC compound. Each wall of the module is essentially solid plastic, optionally with one or two apertures in relatively close proximity to the top of the module to aid in the use of a crane to move the module into position for insertion into the seabed. There is no need for the area to be excavated and trenched prior to installation of any module. In actual construction, the seawall is fabricated starting with the closed end of the module and subsequently extended by attaching other closed end modules or an end cap.

When the retaining wall modules are filled with pea gravel, the seawall can self-drain. This typically means that the amount of void or open space in the combination male projection/female channel can range in the embodiment illustrated in FIG. 14 to range from approximately 5% open void space to approximately 60% or greater. The male projection typically occupies and fills approximately about 33% to 50% of the female channel. It is understood that these figures may be either greater or smaller depending on the end-use application, the thickness of the walls of the module, etc. An issue which is believed to occur with other products, but not with that of the present invention, is that of welding of the interlocks. With other sheet piles of retaining walls, the interlock clearance is tight enough that in difficult driving conditions where progress is slow, the vibrations from the vibratory hammer will actually develop enough frictional heat within the interlock to soften the composition of the joints connecting adjacent wall modules and weld them together so that further installation of the sheet becomes impossible. With the significantly larger clearance within the finger joint interlocks, there is freer vibration and less friction. This minimizes the number of modules which have to be discarded due to the welding phenomenon. In a typical interlock configuration of the present invention, there is preferably at least about 30% free space, more preferably at least about 40% free space, most preferably 50% free space within the interlock voids. With other products, it is believed that no more than about 25% free space is present.

In a preferred embodiment of the invention, the wall thickness will range from approximately 0.25 inches to 0.70 inches, although both higher and lower amounts are within the scope of this invention. The amount of movement of the male projection in the female channel expressed as a percentage of wall thickness ranges between 10%, preferably 20% up to 100% or more.

Figure 14:
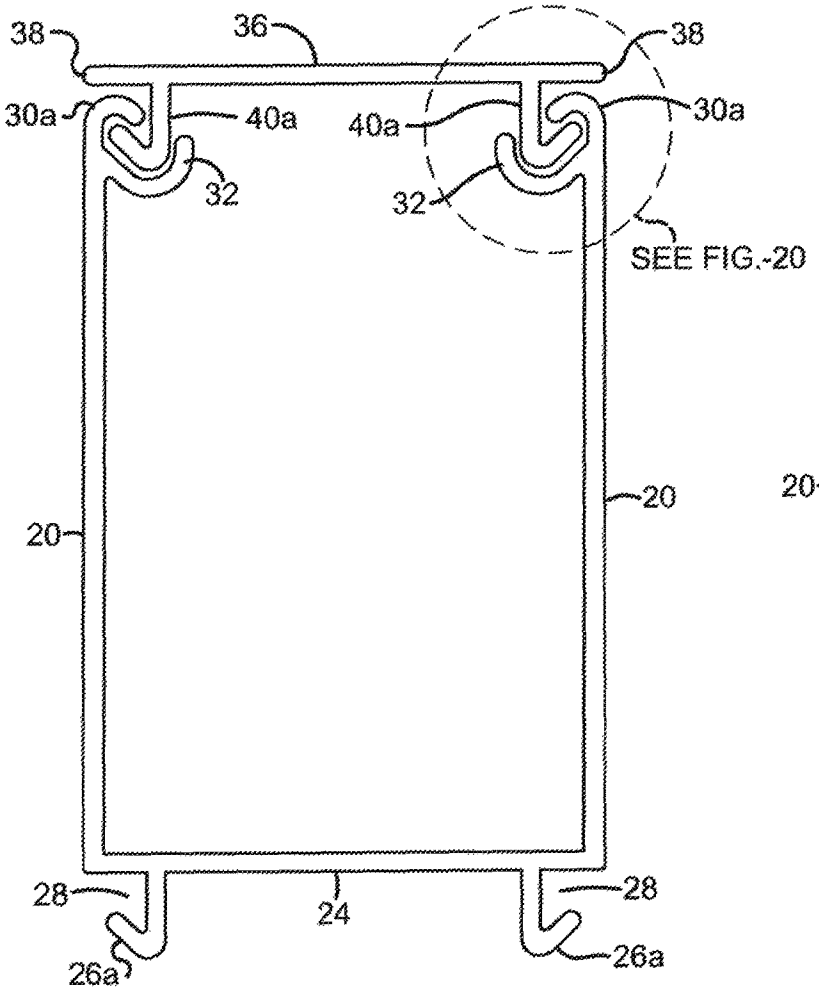
FIG. 14 is an expanded top plan view of an end module of the retaining wall illustrating the fastening of the end module with an open polygon shape with areas of non-contiguous contact or gaps in the joint to allow water or other fluid egress from one side of the wall to the opposite side utilizing two opposed outwardly facing "J-shaped" hooks in the joint.
Figure 16:
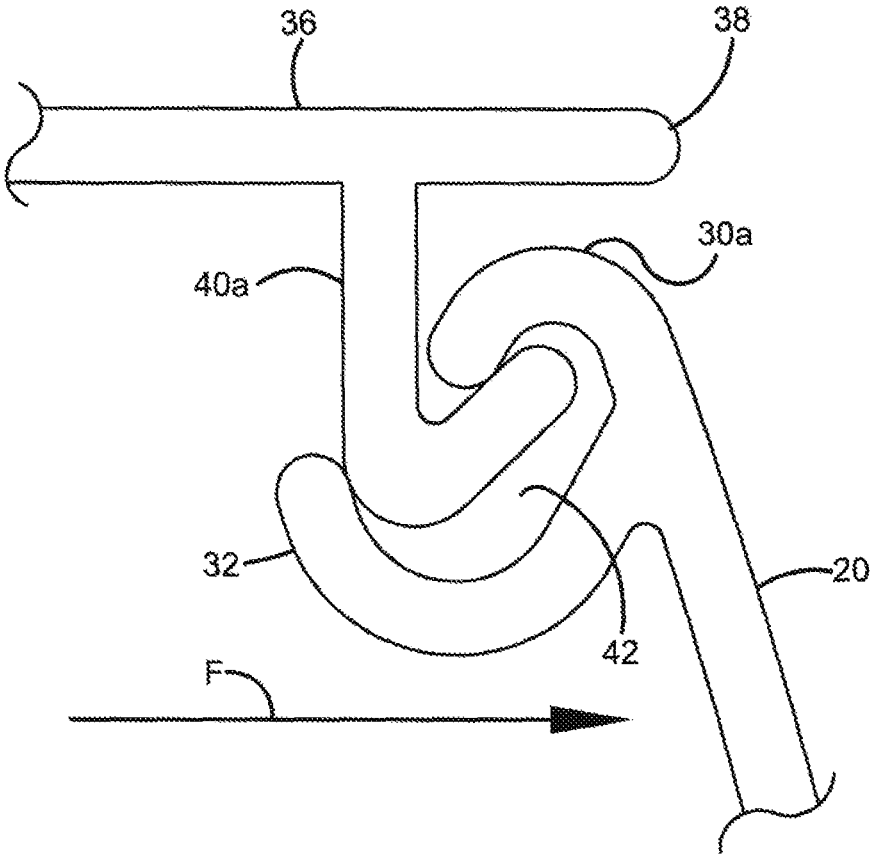
FIG. 16 is an enlarged top plan view of one joint of FIG. 15 upon continued application of a lateral outward force (F) and its associated impact on the joint, illustrating the joint becoming even more firmly attached due to the "J-shaped" configuration, rather than becoming dislodged as illustrated in FIG. 13.

To demonstrate the self-draining concept, a modular seawall was constructed in a manner like that illustrated in FIG. 14. The wall was six feet high and ten feet long and filled with #57 stone. A French drain was underneath the entire depth of the wall and three feet wide. The soil surface of the French drain was lined with plastic so no water could bypass the wall without going through the wall. Initially a flow rate of 20 gallons/minute was poured into the top of the French drain. This was equivalent to an approximate rainfall of about 10 inches per hour of rainfall. At this rate, the water backed up behind the wall to a depth of 5 inches and remained constant. After 20 minutes, the rate was increased to 50 gallons per minute. For this flow rate, the water behind the wall increased to a depth of 13 inches, and then remained constant. Approximately 1200 gallons of water passed through the wall in 35 minutes.

The above results indicate that even during a torrential rainfall, the water level behind the wall will never be more than about 5 inches higher than the canal level. Adding drains through the wall was not required if the drain was filled with gravel so that the joints did not clog with fine particles, although the addition of apertures is not precluded. It is to be recognized that when the retaining wall is filled with concrete, this self-draining feature is not possible, or very limited.

Another aspect of this invention resides in the essentially flat profile of the seawall when constructed. See U-shaped modules 20 and curved module 46 in FIG. 1 which minimizes the amount and size of the indentations in the adjacent side wall panels. This is important in tidal basin areas where the essentially flat sides, including the joints as there is less eddying, which is a factor in the amount of noise generated adjacent to the seawalls by the tides coming in and out.

Figure 21:
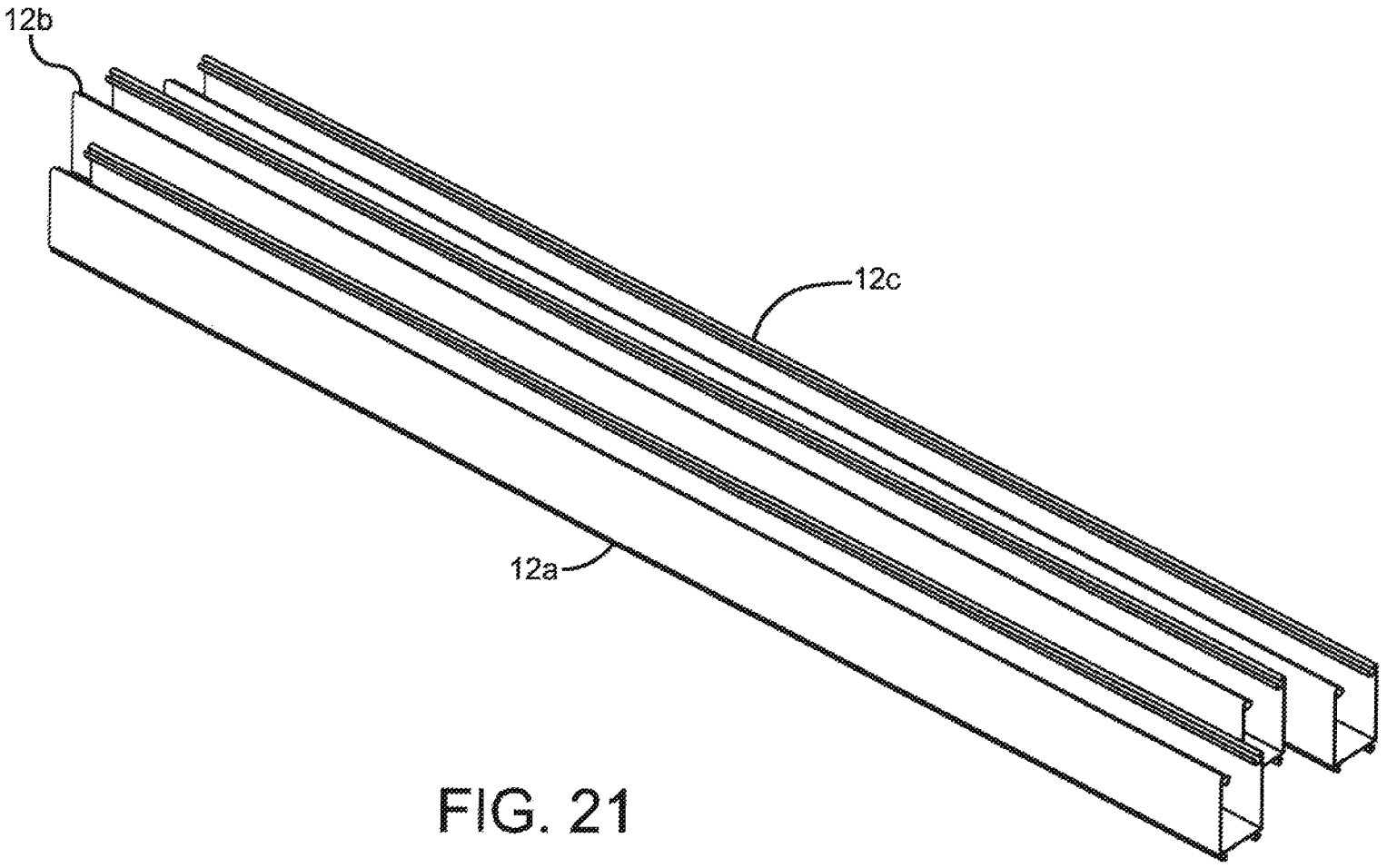
FIG. 21 is a perspective view of three elongated U-shaped channel modules with designed for mating engagement of a male projection into a female receiving channel.
Figure 22:
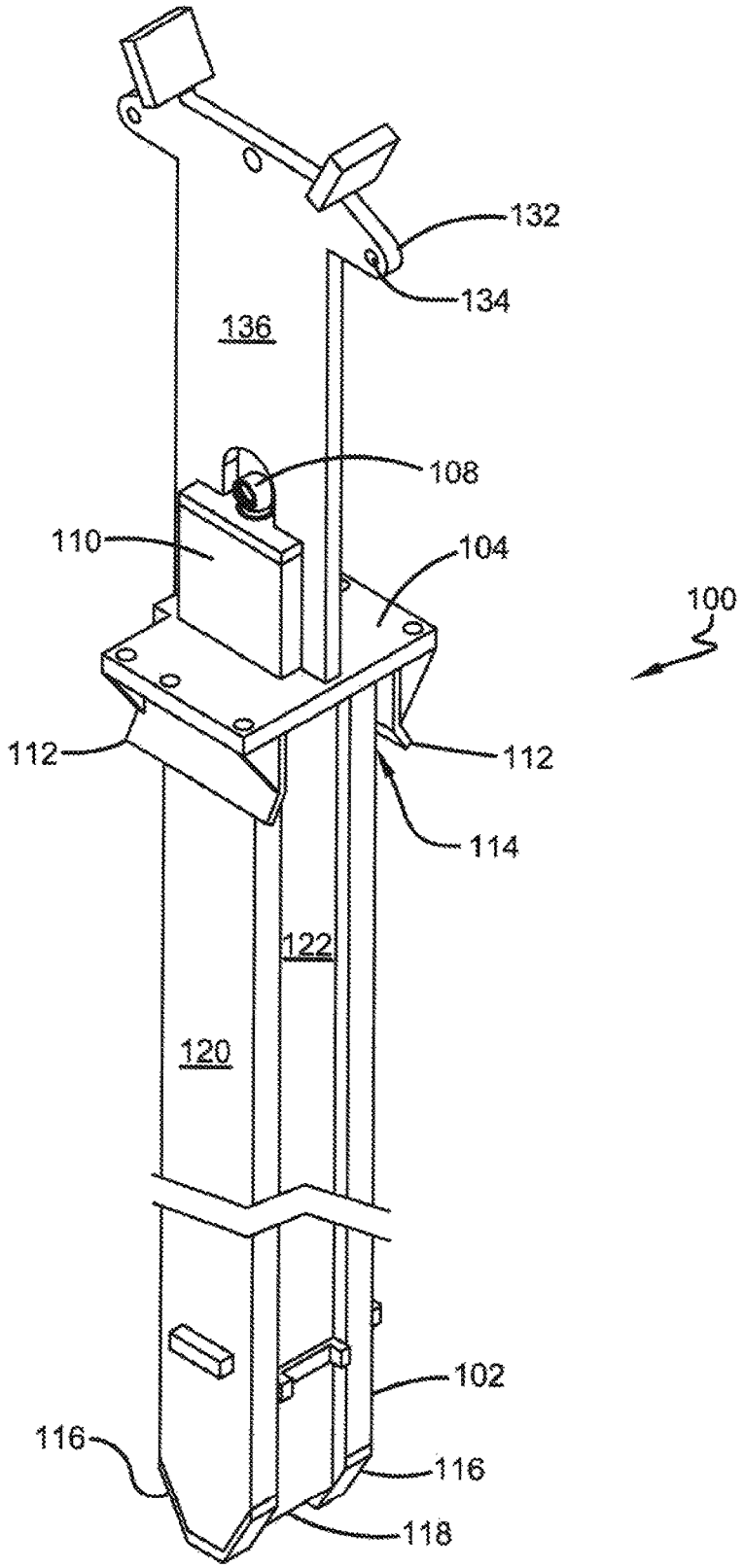
FIG. 22 is a perspective view of an internal mandrel for use in inserting the elongated channel modules of FIG. 21 into soil.

At least part of the present invention resides in the approach utilized in installing elongated U-shaped channels 12*a*, 12*b*, 12*c* (illustrated in FIGS. 1-8, 19 and now FIG. 21). Although most of the subsequent discussion will focus on open U-shaped retaining wall modules, there is no need to limit the invention to that configuration. Open geometries are preferred, but in some instances, it is desirable to have closed geometries for the retaining wall modules, and that is also within the scope of this invention. When installing lengths of the modular retaining walls, each U-shaped channel module is connected to its adjacent module by the combination of sliding mating engagement of a male projection into a female receiving channel as discussed previously. However, preserving vertical alignment of each module of the retaining wall is difficult because the soil underneath the targeted insertion location is often not uniform, and contains various hard and difficult to move objects, e.g., rocks and boulders (and even buried debris) which tends to shift the vertical alignment and/or damage the module of the retaining wall being inserted during the insertion process. This invention minimizes if not eliminates, the above issue with vertical alignment by employing a two-fold approach: using both a vibratory device (e.g., a vibratory hammer) positioned at a top of the mandrel in combination with a pressurized fluid (either liquid or gas) which flows through the internal mandrel and emanates at an opposed end at a pressure sufficient to effect effectively facilitate downward movement of the mandrel into the soil below. While use of pressurized fluid(s) through an internal channel within the mandrel is beneficial when hard objects are encountered, it should be recognized that the mandrel is also used in homogenous soils that do not have the hard objects. The invention is applicable in any soil that is either too dense or to stiff such that the energy required to install the sheet exceeds the strength of the sheet without the internal mandrel support. In this instance, the soil itself has become the hard object. It is equally recognized and within the scope of this invention to employ combinations of fluids, i.e., two or more different liquids, two or more different gases, and/or two or more fluids comprising at least one liquid fluid and at least one gaseous fluid.

Figure 23:
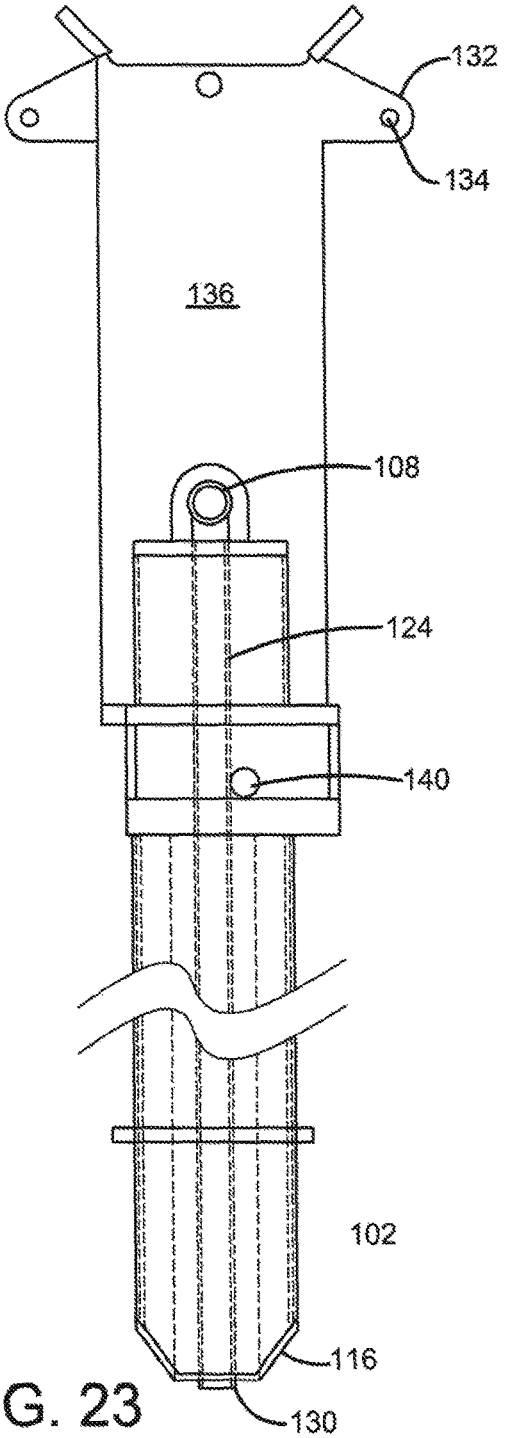
FIG. 23 is a side elevational view of the internal mandrel of FIG. 22.

As better illustrated in FIGS. 22-26, internal mandrel 100 has two opposed pairs of connected sides 120, 122 forming an enclosed longitudinal mandrel channel 124 (better illustrated in FIG. 23). Each of the pair of connected sides is terminated at top shelf portion 104 and mandrel bottom portion 118, the bottom portion being beveled 116 in some instances where required in penetrating various sub-surface geological formations. The top shelf portion of the mandrel is securely positioned to at least one of the opposed pair of connected sides of the mandrel, and preferably to all sides. Extending upwardly from top shelf portion 104 is upwardly-extending projection portion 106, preferably having relatively flat sides 136 for effecting a releasably secured connection with a pair of jaws of a vibrator (not illustrated in the Figure but illustrated in FIG. 32). Positioned toward the lower half of the upwardly-extending projection portion 106 is fluid conduit inlet 108, which is securely attached to an extending portion of top shelf 104. The fluid conduit inlet may be welded to the upper portion of the mandrel channel 110 or may be threadably affixed to the mandrel channel or affixed using other securing means as would be within sound engineering judgment. At a base of mandrel bottom portion 118 is fluid conduit outlet 130 (better illustrated in FIGS. 23 & 24). The fluid conduit outlet may have various geometric configurations depending on the difficulties experienced in penetrating through the soil. When higher velocities are useful, the fluid conduit outlet or orifice 130 will be of a smaller diameter than when lower velocities are required. The orifice can be of any applicable geometric shape as known within sound engineering judgment.

On the lower side of top shelf portion 104 is a pair of opposed guides 112 spaced apart from at least one pair of opposed connected sides 120, 122 thereby forming slots 114 dimensioned to accommodate a thickness of a retaining wall module. Toward a top of upwardly-extending projection portion 106 is a pair of laterally extending ears 132 having apertures 134 disposed therein for use in the initial positioning the mandrel using either guy wires or straps recognizing that apertures 134 could just as easily be positioned within the essentially flat sides 136 of upwardly-extending projection portion 106 of the mandrel but out of the way of the vice-like jaws of the vibrator.

Figure 24:
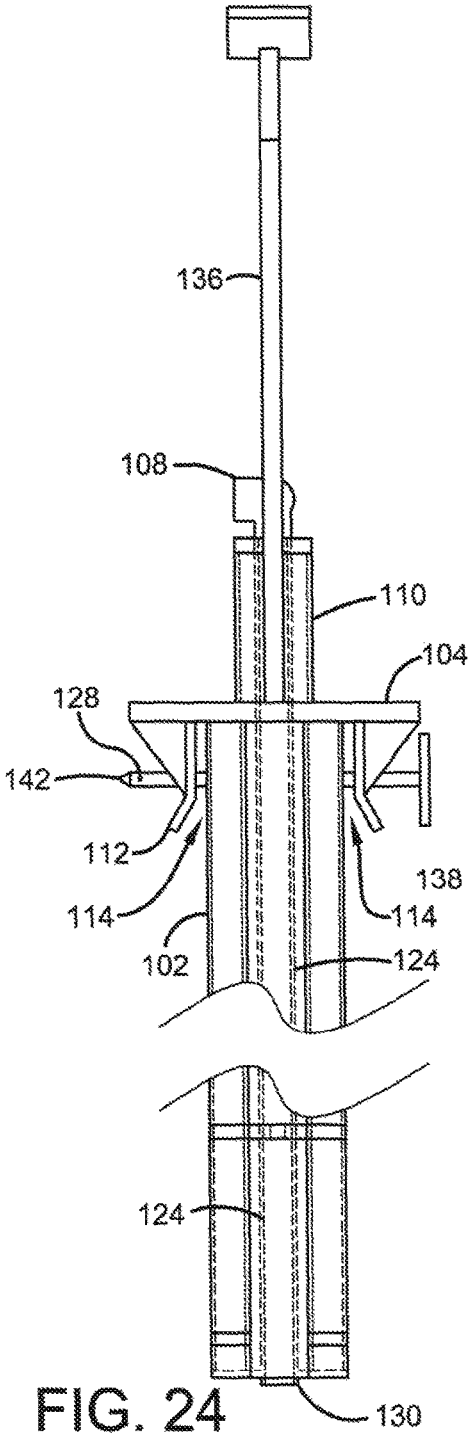
FIG. 24 is a side elevational view of the internal mandrel of FIG. 23 turned 90° along its longitudinal axis.

As illustrated in FIGS. 23-24, fluid conduit inlet 108 may be a pipe fitting and therefore is essentially cylindrical, or it may be another geometric shape. For ease of construction, the longitudinally extending portion of the fluid conduit is typically a pipe 124 having a cylindrical bore of defined dimensions, recognizing the tradeoff between pressure and flow rate. The larger the bore, the greater the flow rate, but typically the lower the pressure of the fluid disposed within the bore. The smaller the bore, the lower the flow rate, but typically, the higher the pressure of the fluid disposed therein. The geology of the subsurface will often determine the appropriate size/pressure/flow rate combination needed. Optionally, the exterior about fluid conduit 124 within the mandrel walls 120, 122 may have spacers positioned about the fluid conduit or pipe 124. Lifting pin 138 is often inserted into the bottom portion of mandrel 102 through lifting pin aperture 140 and secured with cotter pin 150 inserted through aperture 128. The lifting pin is only inserted after a retaining wall module has been positioned into gap 114, and keeps the module in position as the combination mandrel/module is hoisted into a more vertical insertion position by a crane.

Figure 25:
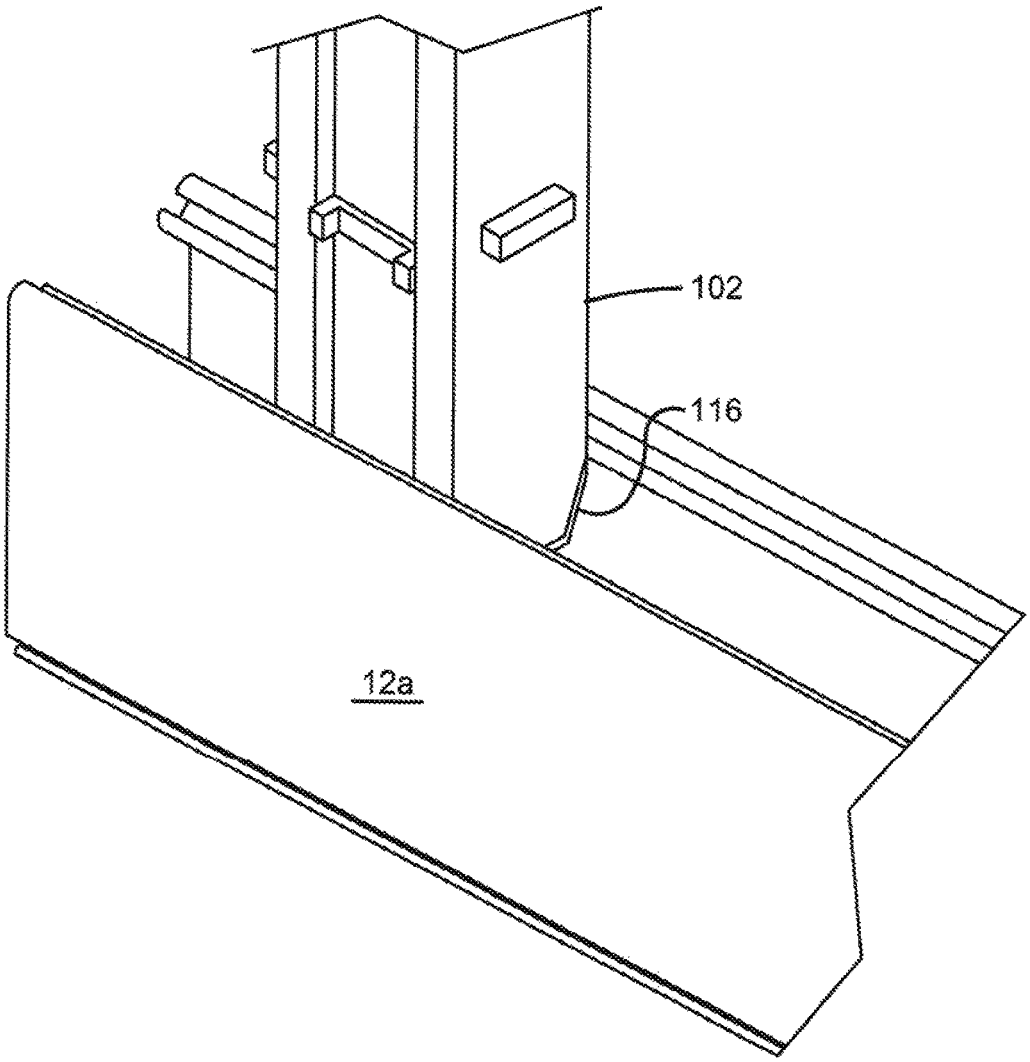
FIG. 25 is a perspective view of the internal mandrel being inserted into an open U-shaped elongated channel module.

FIG. 25 illustrates the initial step in installing retaining wall modules. It is a sequential operation, involving a transverse insertion of bottom end of internal mandrel 102 into one end the open U-channel of retaining wall module 12*a*, preferably adjacent to one end of the module, to minimize subsequent sliding of the module into gaps 114 as discussed later. While an insertion into an open U-channel is the preferred approach, the invention is not limited to retaining wall modules having three connected sides and a fourth open side. In fact, the insertion of the bottom end 102 of the mandrel could also be effected into a closed-channel module as illustrated in FIG. 8 with some modifications, namely the initial positioning of the mandrel will not be transverse as preferred for a U-shaped channel, but the mandrel will be inserted coincidentally with the longitudinal axes of the mandrel and the retaining wall channel. The orientation of the mandrel while being positioned within the open or closed-channel module is not critical. Some crane operators prefer that beveled edges 116 be positioned to initially contact the open portion of the U-shaped channel, although this is not necessary and insertion is quite possible if the mandrel is rotated by 90°.

Figure 26:
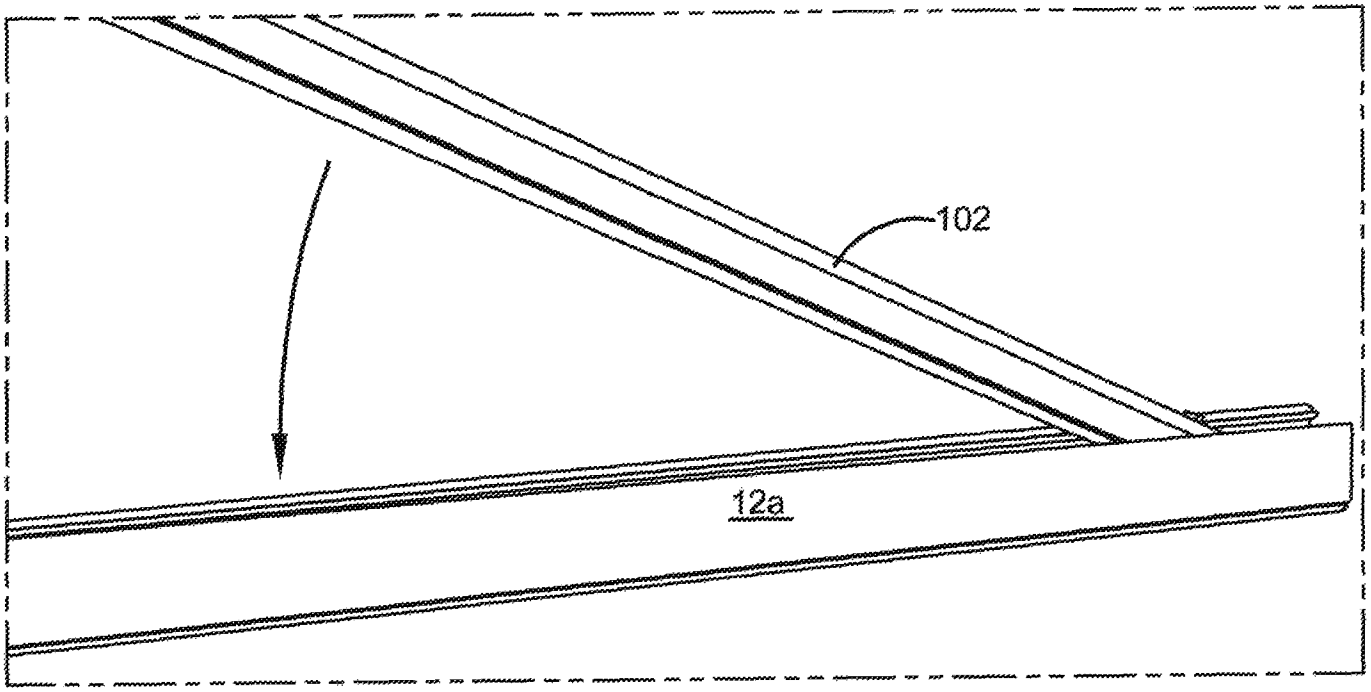
FIG. 26 is a side perspective view of the internal mandrel being lowered into the open U-shaped elongated channel module.
Figure 27:
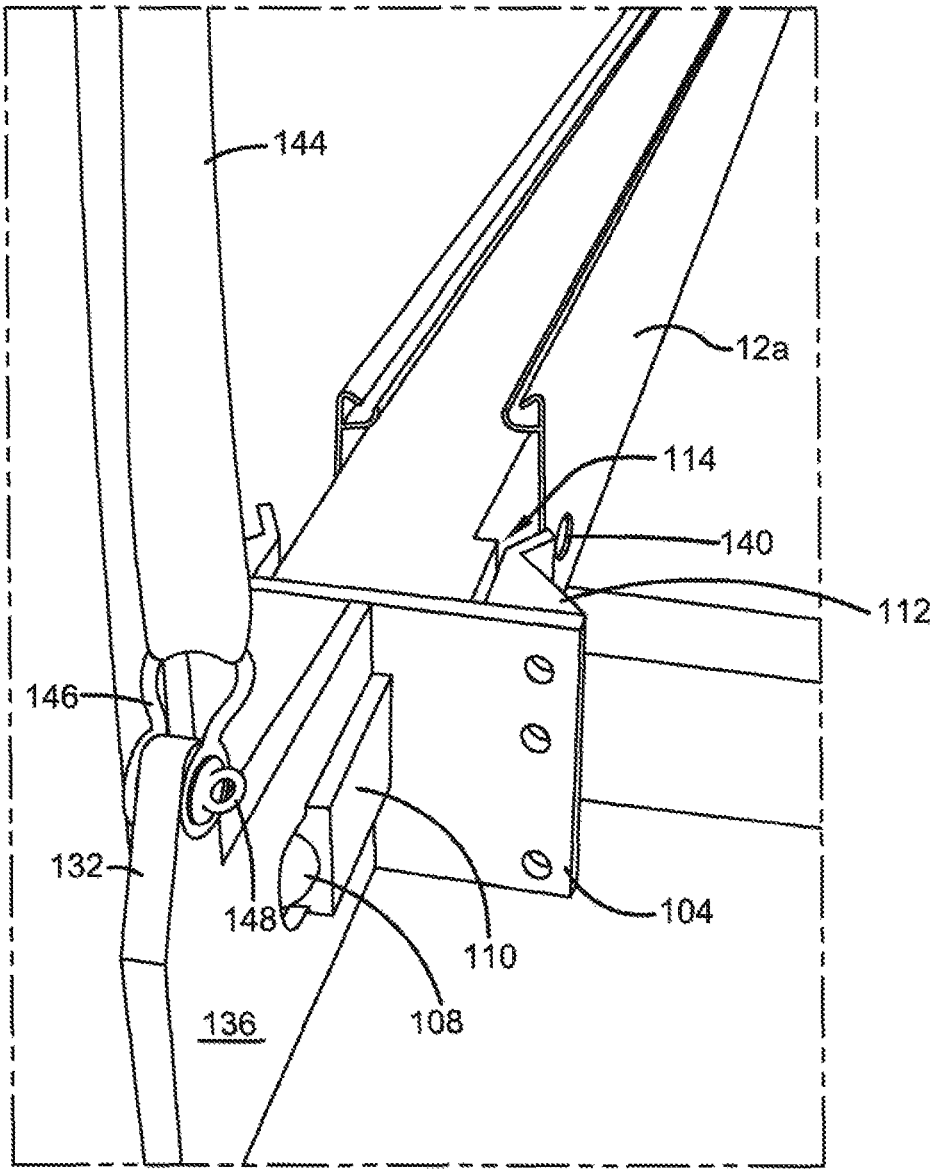
FIG. 27 is a top perspective view of the internal mandrel positioned within the open U-shaped elongated channel module with lifting straps affixed to the upper portion of the upwardly-extending projection of the mandrel.
Figure 28:
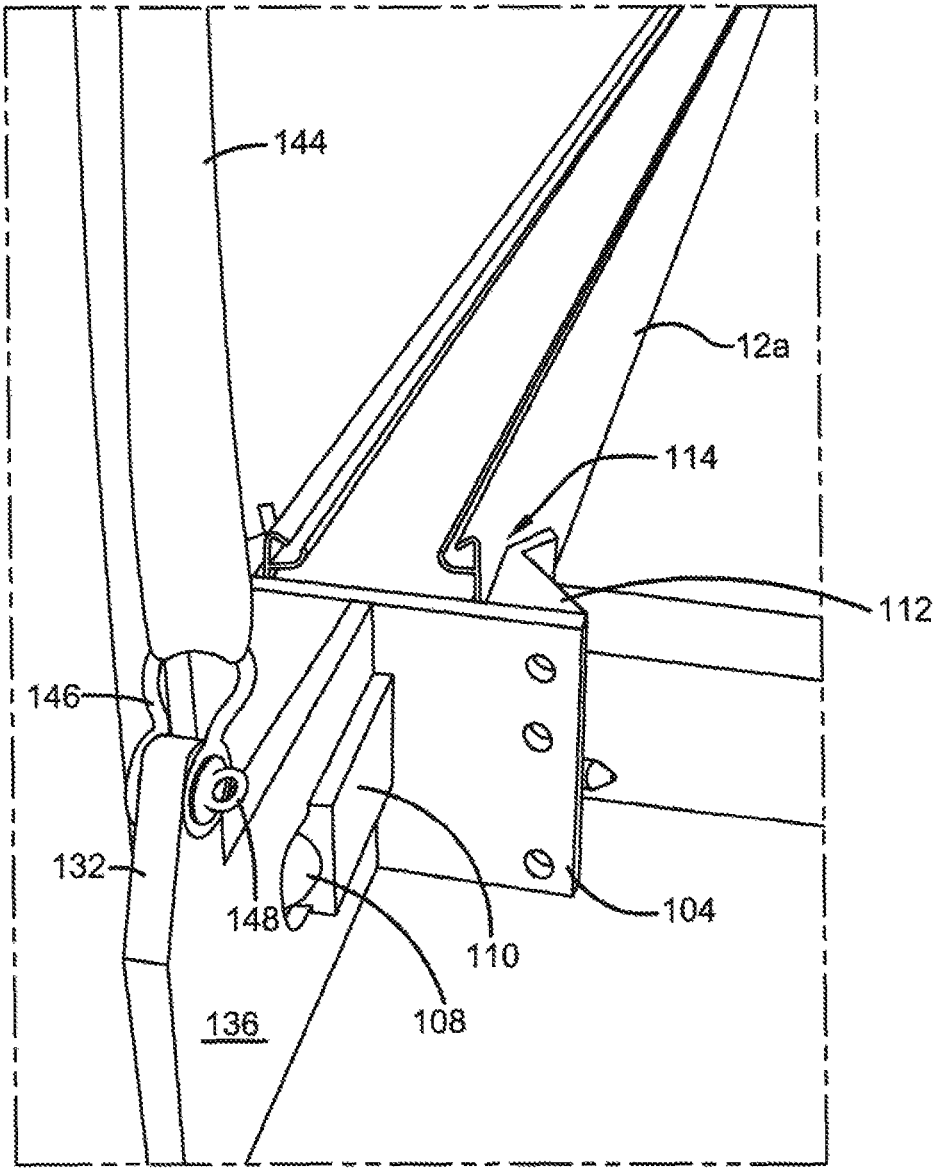
FIG. 28 is a top perspective view of the internal mandrel positioned xxxxx.

After initial insertion and with further reference to a U-shaped channel module, internal mandrel 102 is lowered from its initial transverse or at least oblique position to the longitudinal axis of the module to a more horizontal and parallel position as illustrated in FIG. 26 with the directional arrow. When the longitudinal axes of both the internal mandrel and module are essentially parallel and coincident as illustrated in FIG. 27, the mandrel is pivoted in a downward direction so that a top portion of U-shaped channel is brought into abutting relationship with a bottom of top shelf portion 104 with at least a pair of side walls of module 102 thereby aligning lifting pin aperture 140 along a center axis for insertion tip 142 of lifting pin 138 and securing the same with cotter pin 150 through aperture 128. This is typically effected by the application of a force to straps or wire rope 144 which are pivotally connected to at least one ear 132 by combination of clevis pin 148 and shackle 146 as illustrated in FIG. 28.

Figure 29:
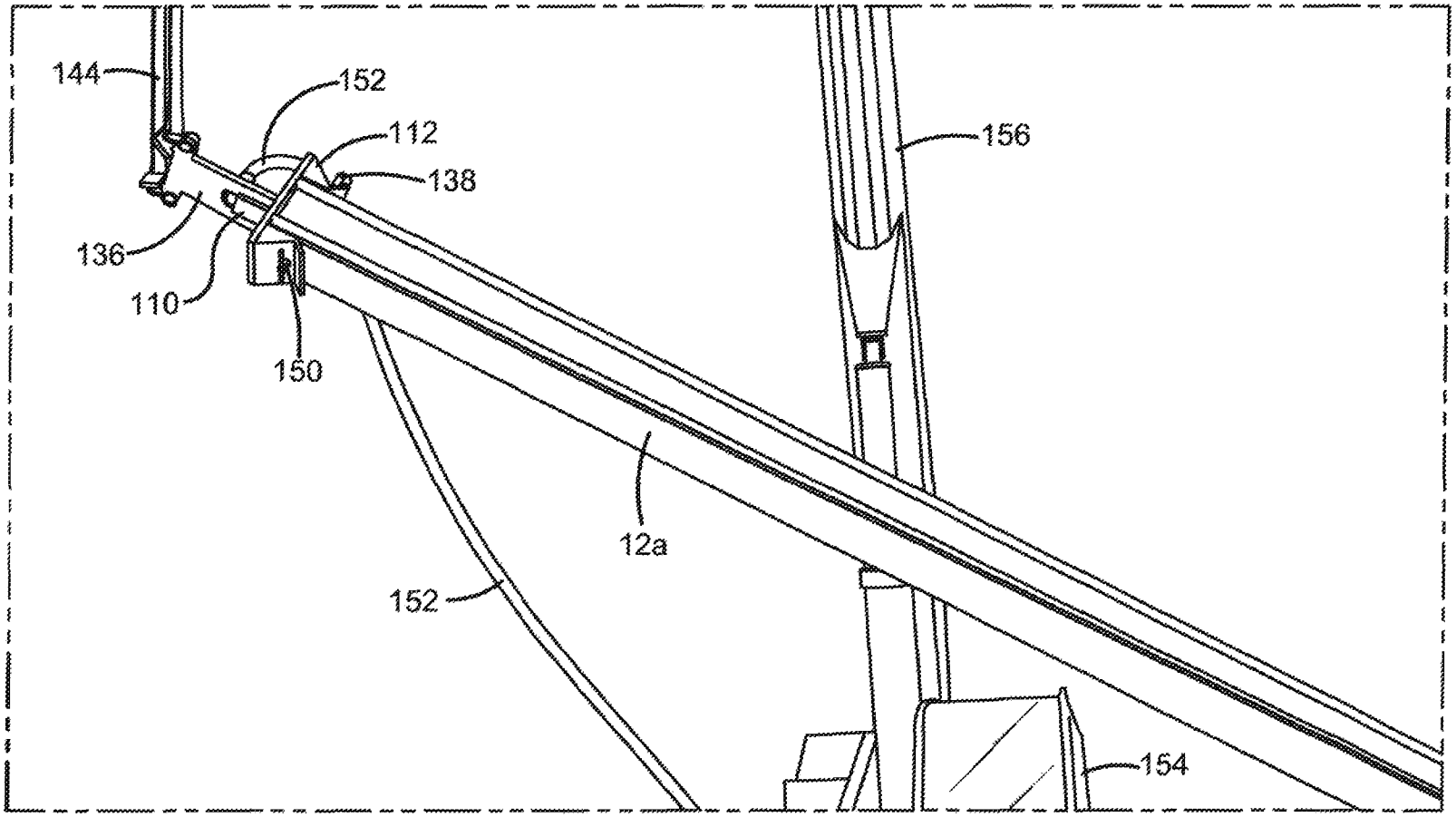
FIG. 29 is a perspective view of the internal mandrel positioned within the open U-shaped elongated channel module being lifted into position by a crane.
Figure 30:
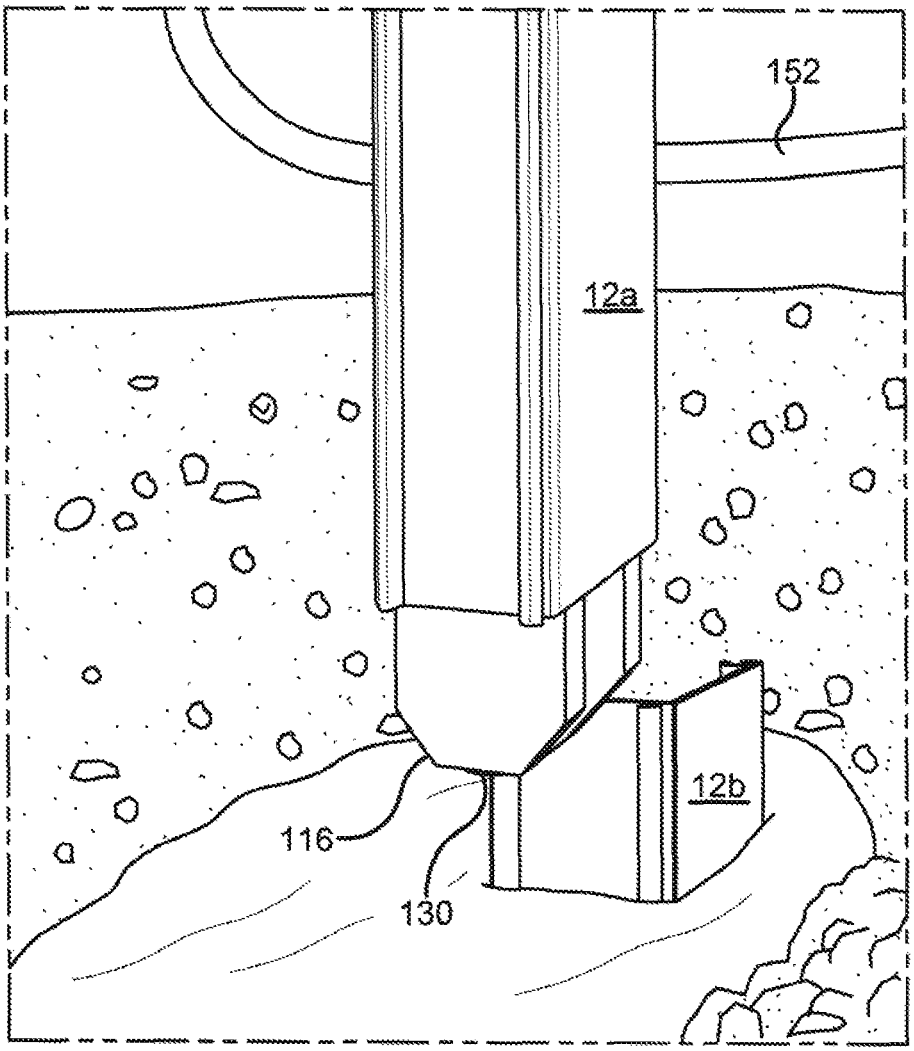
FIG. 30 is a side perspective view of the internal mandrel positioned within the open U-shaped elongated channel module positioned adjacent to another elongated channel module for sliding engagement of the mating male projection and female receptacle.
Figure 31:
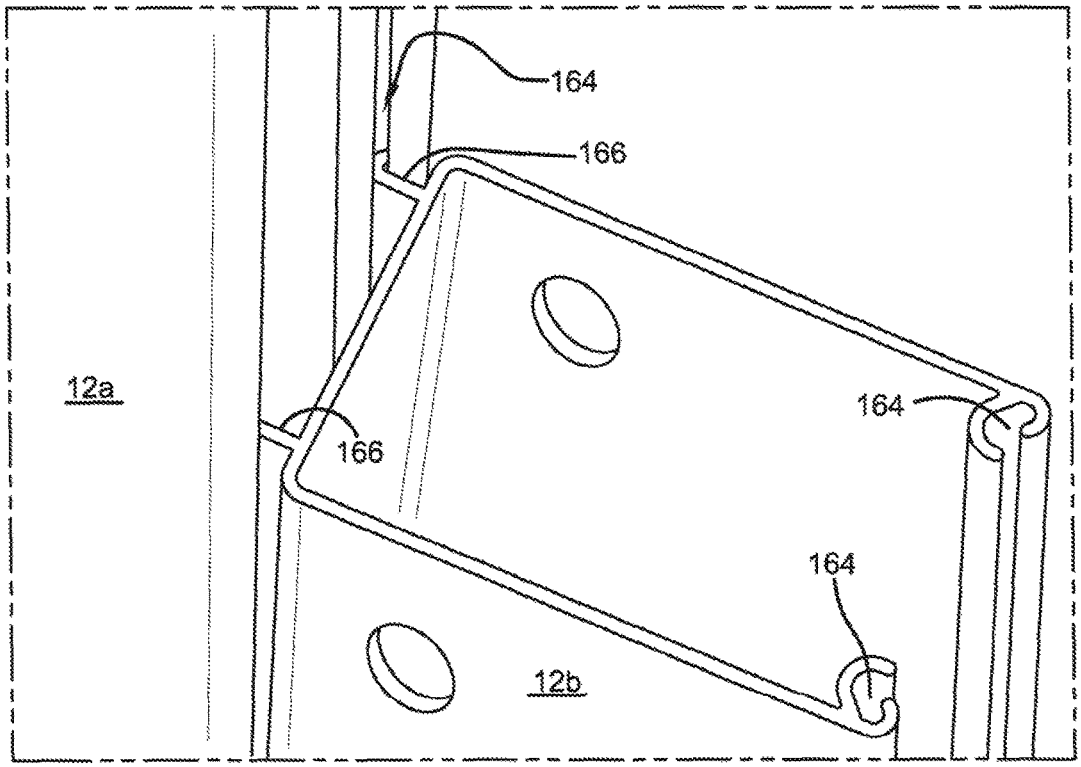
FIG. 31 is a top perspective view of a module in mating engagement with a previously installed elongated channel module.

After attaching a pressurized source of fluid 152 into mandrel channel 110 at fluid conduit inlet 108, crane 154 hoists the combination of mandrel 100 with attached retaining wall module 12*a* upward by the application of a lifting force to one end of the mandrel ears using either straps or wire rope 144 as illustrated in FIG. 29. Upward lifting is continued until mating and self-aligning engagement between respective fingers or "J-shaped" hooks 166 and mating receiving channels 164 is effected and the combination of internal mandrel and retaining wall module is lowered for sliding engagement between modules 12*a* and 12*b* as illustrated in FIGS. 30-31. It is important that the internal mandrel be dimensioned so as to be protruding at least some distance from the bottom of module 12*a* during the insertion process in that damage to the module (which is preferably polyvinyl chloride or PVC) is minimized in this geometry. It should be recognized that the mandrel will be a hard metal as would be chosen within sound engineering principles, e.g., a steel having a sufficient hardness so as to resist deformation during the insertion process.

Figure 32:
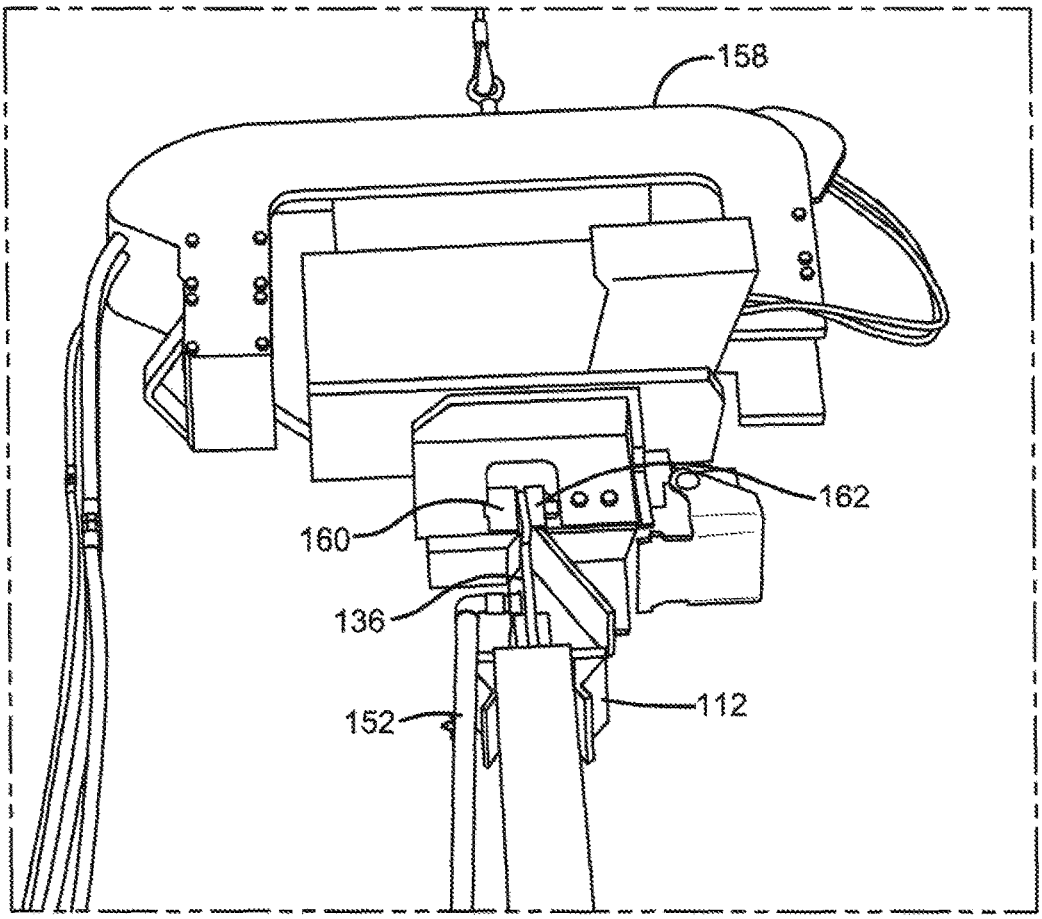
FIG. 32 is a perspective view of a vibratory hammer attached to the upwardly extending projection of the internal mandrel.

After partial insertion of the lower part of the mandrel into the substrate into which the combination mandrel/retaining wall module is to be inserted, vibratory hammer 158 is positioned at a top of the mandrel with opposed clamping jaws 160, 162 pneumatically are clamped to essentially flat sides 136 of upwardly-extending projection portion 106 of the mandrel as illustrated in FIG. 32.

In operation, vibratory hammer is started, and either coincidentally, after or before, the pressurized fluid can flow into the fluid conduit inlet 108. When the fluid being inserted is a liquid, water is preferred. However, not all locations will have easy access to a source of fresh uncontaminated water, thereby switching the source of the pressurized fluid to being a gas, preferably compressed air, although any gas would be usable. Compressed air is typically chosen due to its cost. The liquid may also contain additives as permitted by governmental regulations, and drilling muds may be desirable in some instances. The pressurized fluid may be generically classified as (1) compressed air; (2) air/water, the water added to increase viscosity, flush the hole, provide more cooling, and/or to control dust; (3) air/polymer, e.g., where the added polymer is added to the water & air mixture to create specific conditions, often a foaming agent is the added polymer; (4) water by itself is sometimes used; (5) water-based mud (WBM), which typically begin with water, then clays and other chemicals are incorporated into the water to create a homogeneous blend resembling something between chocolate milk and a malt (depending on viscosity), the clay is usually a combination of native clays that are suspended in the fluid while drilling, or specific types of clay that are processed and sold as additives for the WBM system, the most common of these is bentonite, frequently referred to as "gel", in which many other chemicals (e.g. potassium formate) are added to a WBM system to achieve various effects, including: viscosity control, shale stability, enhance drilling rate of penetration, cooling and lubricating of equipment; (6) oil-based mud (OBM) which is a mud where the base fluid is a petroleum product such as diesel fuel which withstand greater heat without breaking down, but obviously present negative environmental considerations.

The amount of pressure employed with the pressurized fluid is dependent on various factors, including the size of the pressurized fluid conduit, size of respective input piping, egress orifice size and design and is known to those having ordinary skill in the art and with resource to well-known design principles and design requirements based on the underlying geology of the soil.

The pressurized fluid creates a turbulent area of gas (when used)/liquid (when used)/solids adjacent and below fluid conduit outlet 130, the turbulence facilitating the insertion of the mandrel/retaining wall module combination in a vertical or nearly vertical orientation even when encountering hard physical objects, which through the physical action of the pressurized fluid facilitates insertion of the combination mandrel/retaining wall module in conjunction with the vibratory hammer. After the retaining module has been driven to the correct depth, the process is reversed with removal of the mandrel. The retaining wall modules are often subsequently filled with concrete.

In the foregoing description, certain terms have been used for brevity, clearness and understanding; but no unnecessary limitations are to be implied therefrom beyond the requirements of the Prior Art, because such terms are used for descriptive purposes and are intended to be broadly construed. Moreover, the description and illustration of the invention is by way of example, and the scope of the invention is not limited to the exact details shown or described.

The best mode for carrying out the invention has been described for purposes of illustrating the best mode known to the applicant at the time. The examples are illustrative only and not meant to limit the invention, as measured by the scope and merit of the claims. The invention has been described with reference to, preferred and alternate embodiments. Obviously, modifications and alterations will occur to others upon the reading and understanding of the specification. It is intended to include all such modifications and alterations insofar as they come within the scope of the appended claims or the equivalents thereof.

What is claimed is:

1. A process to install retaining wall modules, at least one module having a longitudinally open U-shaped channel disposed therein comprising the steps of:

inserting a mandrel into the at least one module having the longitudinally open U-shaped channel, the mandrel having a mandrel length along its longitudinal axis greater than the module length along its longitudinal axis, the mandrel comprising:

two opposed pairs of connected sides forming an enclosed longitudinal mandrel channel, the channel having a top portion and a bottom portion;

a fluid conduit disposed within the mandrel channel, the fluid conduit having an inlet and an outlet;

the top portion of the mandrel securely positioned on a top of at least one of the opposed pair of connected sides of the mandrel, the top portion having an upwardly-extending projection portion for releasable secured connection with a pair of jaws of a vibrator, the top portion having a pair of opposed downwardly-extending slots to permit insertion of a pair of opposed sides of the module, the top portion also containing a fluid inlet into the fluid conduit;

the bottom portion of the mandrel securely positioned on a bottom of the at least one of the opposed pair of connected sides of the mandrel and having an egress opening for the fluid conduit at the bottom of the mandrel and positioned at an extremity of the mandrel beyond the module length of the open U-shaped channel along its longitudinal axis, the bottom portion of the mandrel extending beyond the longitudinal length of the U-shaped channel of the retaining wall module;

affixing a source of at least one pressurized fluid to the fluid inlet of the top portion of the mandrel;

affixing the vibrator to the upwardly-extending projection portion by engagement of the upwardly-extending projection with the pair of jaws of the vibrator;

positioning the module for insertion into a location;

ejecting pressurized fluid through the egress opening for the bottom portion of the fluid conduit while vibrating the mandrel to allow penetration of the U-shaped channel and mandrel into the location.

2. The process of claim 1 wherein the at least one pressurized fluid is selected from the group consisting of compressed gas and pressurized liquid.

3. The process of claim 2 wherein the compressed gas is air and the pressurized liquid is water.

4. The process of claim 1 wherein the fluid inlet into the fluid conduit is a 90° elbow.

5. The process of claim 1 wherein a pressure of the pressurized fluid is at least approximately 50 psig when the fluid is a gas, and wherein a pressure of the pressurized fluid is at least approximately 5 psig when the fluid is a liquid.

6. The process of claim 1 wherein the bottom portion of the mandrel is either beveled or tapered.

7. The process of claim 1 which further comprises the step of:

filling each module with concrete.

8. The process of claim 1 wherein the step of positioning the module for insertion into a location comprises:

adding at least one second module to a first module by sliding mating engagement of a male projection into a female receiving channel.

9. The process of claim 1 wherein the step of positioning the module for insertion into a location comprises:

adding at least one third module to a second module by sliding mating engagement of a male projection into a female receiving channel.

10. The process of claim 1 which further comprises adding a pair of opposed and connected weep holes into at least one module to permit draining from an uphill ground location to a water location, the weep hole on the water side of the module positioned above a water line.

* * * * *